US005992850A

United States Patent [19]

Li

[11] Patent Number: 5,992,850

[45] Date of Patent: Nov. 30, 1999

[54] FOUR-LAYER INTELLECTUAL CUBE

[76] Inventor: Chen Sen Li, No. 25, Lane 169, Cheng-Ho Rd., Been-Shang Village, San-Min Area, Kaohsiung, Taiwan

[21] Appl. No.: 09/047,380

[22] Filed: Mar. 25, 1998

[51] Int. Cl.[6] ..... A63F 9/08

[52] U.S. Cl. ..... 273/153 S

[58] Field of Search ..... 273/153 S, 153 R, 273/157 R

[56] References Cited

U.S. PATENT DOCUMENTS

| | | | |
|---|---|---|---|
| 5,271,688 | 12/1993 | Chang | 273/153 S |
| 5,826,871 | 10/1998 | Li | 273/153 S |

FOREIGN PATENT DOCUMENTS

| | | | |
|---|---|---|---|
| 3125817 | 1/1983 | Germany | 273/153 S |
| 1258457 | 9/1986 | U.S.S.R. | 273/153 S |
| 1733028 | 5/1992 | U.S.S.R. | 273/153 S |
| 2111840 | 7/1983 | United Kingdom | 273/153 S |
| 2113104 | 8/1983 | United Kingdom | 273/153 S |

*Primary Examiner*—Steven Wong
*Attorney, Agent, or Firm*—Bacon & Thomas

[57] ABSTRACT

A four-layer intellectual cube is divided on each side thereof horizontally and vertically into sixteen movable smaller blocks. These smaller blocks can be rotated and can slide to change their orientations, so that every side of the intellectual cube can be varied in combination by colors or patterns, and this can arouse brains of people to get an intellectual enhancing effect. In this structure, each side of a central member is mounted with a rotatable block, a first and a second slidable block are clamped between every two rotatable blocks, these slidable blocks limit rotation and sliding areas of four central movable units, eight edge movable units and four corner movable units, in this way, sliding of each movable unit on every side of the four-layer intellectual cube provided with different colors or patterns in operation can change its position, so that the six sides are varied in combination, and thereby complexity of the cube can be increased.

1 Claim, 24 Drawing Sheets

(A)

FOUR-LAYER INTELLECTUAL CUBE

BACKGROUND OF THE INVENTION

1. Field of the Invention

The present invention is related to a four-layer intellectual cube, and especially to a four-layer intellectual square cube having on each side thereof, sixteen movable smaller blocks arranged horizontally and vertical. The smaller blocks can be rotated and can slide to change their orientations, so that each side of the square cube can be varied in combination by colors or patterns, and this can arouse brains of people to get an intelligence enhancing effect.

2. Description of the Prior Art

As shown in FIG. 1, a conventional intellectual cube (or so called magic cube) is a square cube A having six sides each composed of nine (3×3) movable smaller surfaces arranged in three layers. Normally the six sides of the square cube A are each have a different color, i.e., the nine small movable areas in each side formed by the nine smaller blocks are respectively in one color, so that when any layer is rotated to change the positions of the corresponding blocks, the small movable areas in every side in this layer are moved respectively to another side of a different color, and the resulting sides have miscellaneous colors. The way to play is to mix up the colors of the six sides of the square cube A, and then to rotate all the layers to move every group of movable areas having the same color to their proper side, until all the six sides of the square cube A recover their own singular colors.

The structure of the three-layer intellectual cube is now described firstly. It is comprised, as is shown in FIG. 2, of a cross shaped central axle block 1, six rotatable blocks 2, twelve edge-blocks 3 and eight corner-blocks 4.

The cross shaped central axle block 1 is formed by the intercrossing of three axles perpendicular to one another so that the cross shaped central axle block 1 has six pivotal connecting ends 5 extending in different orientations.

The rotatable blocks 2 are pivotally connected respectively to each of the pivotal connecting ends 5, so that the rotatable blocks 2 are located at the centers of the six sides of the square cube A respectively and form therewith "T" shapes. These surfaces face outwardly and are rotatable.

The twelve edge-blocks 3 are each positioned between two neighbouring rotatable blocks 2. Taking the rotatable block 2 that faces to the front side as a reference block, there are four edge blocks 3 allocated to the front surface and respectively at the top, bottom, left and right ends thereof. The rear rotatable block 2 is also accompanied by four edge blocks 3 allocated respectively at the top, bottom, left and right ends thereof; plus other four edge blocks 3 provided in the middle zone between the front and the rear sides, the total amount of the edge blocks 3 is twelve.

The corner blocks 4 are located each between every two edge blocks 3 in any one of the six sides, there are totally eight corner-blocks 4 forming the eight corners of the square cube A, they surround the rotatable blocks 2 together with the twelve edge blocks 3, when in rotation of any layer of the three layer intellectual square cube A, the rotatable block 2 on the layer rotates at its own site, while the corner blocks 4 and the edge blocks 3 in this. layer circle about the rotatable block 2.

By means of the above stated three layer square cube A composed of the cross shaped central axle block 1, the rotatable blocks 2, the edge blocks 3 and the corner blocks 4, any of the six pivotal connecting ends 5 on the cross shaped central axle block 1 is the center of rotation of its corresponding rotatable block 2 (the central movable surface) as well as of the multiple surrounding movable surfaces on the same side as that of the rotatable block 2, and there are totally nine (3×3) movable surfaces in each side of the six sides of the square cube A.

SUMMARY OF THE INVENTION

The aforesaid conventional three-layer intellectual cube has prevailed for a very long time and thus is well known. The inventor of the present invention contemplates increasing the complexity of such an intellectual cube. The most direct idea is to augment the three-layer intellectual cube to a four-layer intellectual cube. In other words, each side of the cube will have sixteen (4×4) movable smaller surfaces. However, this has been found after much study and deliberation to be very difficult, which is why there never has been a four-layer intellectual cube in the markets.

The problem is that it is impossible, in a four layer intellectual cube, to take advantage of the cross shaped central axle block 1 as a center of a four-layer square cube, because the pivotal connecting ends 5 at the centers of the six sides of the square cube can not be positioned in the same way as that of a three-layer square cube A, in which as described above the pivotal connecting ends at the centers of the six sides thereof are each located on a central movable surface of the nine movable surfaces on a corresponding side. Hence a four-layer square cube can not be put into practice with the same structure, and a novel structure is required to be designed.

Despite the above problem, the inventor of the present invention has provided an intellectual four-layer square cube after study and designing of the structure thereof, which can increase the complexity of the conventional intellectual square cube.

In particular, the structure of the four-layer square cube of the present invention has six sides which are each divided vertically and horizontally into sixteen smaller movable surfaces. Each of these smaller movable may be rotated to change their orientation. Every side will have numerous possibilities for combination of these smaller movable surfaces, which can arouse brains of people to provide an intellectual enhancing effect. The complexity of such a combination is larger than that of a conventional three-layer intellectual cube. The structure of the four-layer intellectual cube includes a central axle block, six rotatable blocks, 24 first slidable blocks, 12 second slidable blocks, 24 central movable units, 24 edge movable units, and eight corner movable units. Six pin holes are provided on the six sides of the central axle blocks each pivotally supporting one of the mentioned rotatable blocks. A first slidable block and a second slidable block of different shapes are received between every two mutually neighboring rotatable blocks. The first and second slidable blocks on each side limit 4 central movable units, 8 edge movable units and 4 corner movable units to a moving area in which their orientations can be changed by rotation and displacement. In this way, each side of the four-layer square cube can have a variety of colors or patterns. By displacing the movable units to change their positions, the six sides can have a variety of combinations of these movable units, and the complexity of the intellectual square cube can thereby be increased.

The present invention will be apparent after reading the detailed description of the preferred embodiments thereof in reference to the accompanying drawings.

DETAILED DESCRIPTION OF THE PREFERRED EMBODIMENT

Figure 3:
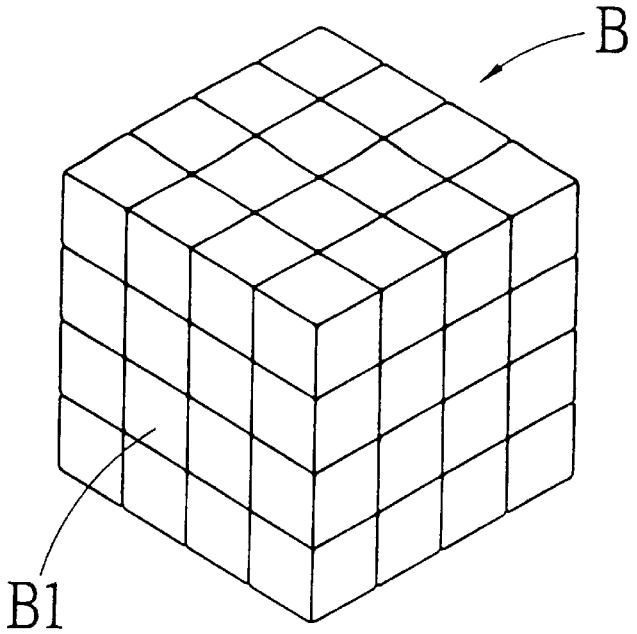
FIG. 3 is a perspective view of a preferred embodiment of the present invention.
Figure 4:
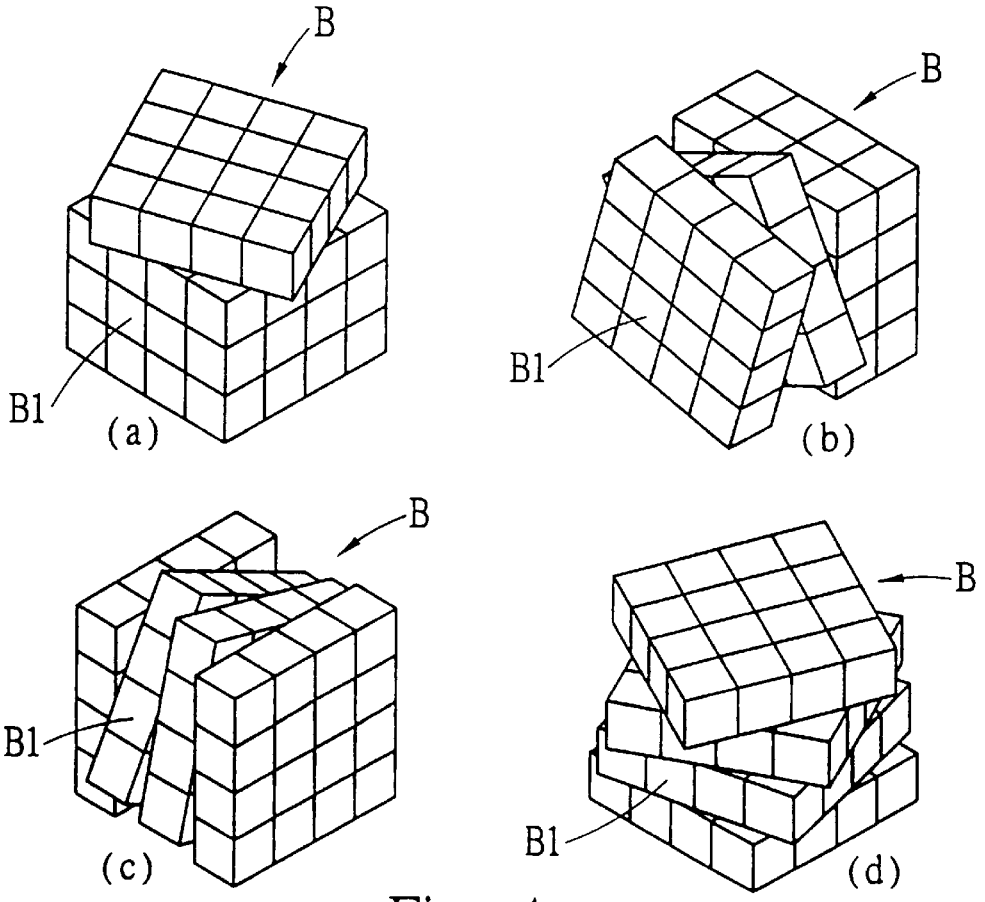
FIG. 4 is a schematic view showing use of the preferred embodiment of the present invention.

Referring to FIGS. 3 and 4, the six sides B1 of the four-layer intellectual square cube B of the present invention are each divided vertically and horizontally into sixteen (4×4) smaller movable surfaces. By rotating of these smaller movable surfaces to change their orientation, every side B1 will have numerous possible; combination of these smaller movable surfaces, which can arouse brains of people to get an intellectual enhancing effect. The complexity of such combinations is larger than that in a conventional three-layer intellectual cube. The structure of the four-layer intellectual cube B, as is shown in FIGS. 5–21, includes a central axle block 10, six rotatable blocks 20 provided at each of six orientations, a plurality of first slidable blocks 30 and second slidable blocks 40 engaged between every two mutually neighboring rotatable blocks 20. The first and second slidable blocks 30, 40 on each side B1 limit four central movable units 50, eight edge movable units 60 and four corner movable units 70 to a moving area in which the movable units may be rotated and displaced to change their orientations. In this way, each side B1 of the four-layer square cube B can have a variety of colors or patterns. The movable units being displaced to change their positions. The six sides B1 can have a variety of combinations of these movable units, thereby increasing the complexity of the intellectual square cube B.

The structure of various members are now described as follows in detail in reference to the accompanying drawings.

Figure 5:
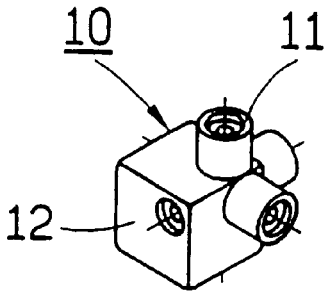
FIG. 5 is a perspective view of a central axle block of the present invention.
Figure 6:
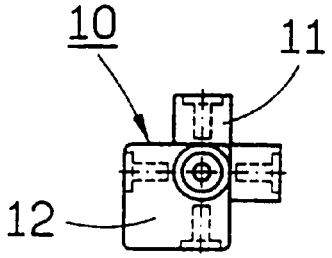
FIG. 6 is a front view of the central axle block of the present invention.

Referring to the structure of the axle block 10 shown in FIGS. 5 and 6, the axle block 10 is in the center of the four-layer square cube B, and the six sides B1 of the axle block 10 are each provide with a pin hole 11. The axle block 10 also comprises a seat block 12 which defines one corner thereof the center of the axle block 10.

Figure 7:
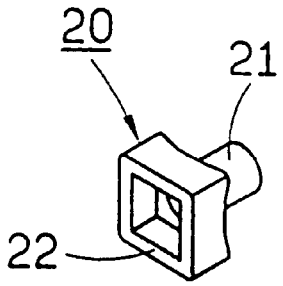
FIG. 7 is a perspective view of a rotatable block of the present invention.
Figure 8:
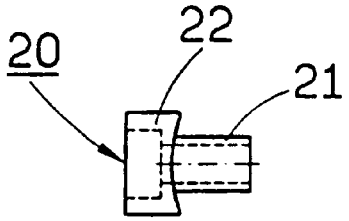
FIG. 8 is a front view of the rotatable block of the present invention.

Referring to FIGS. 7 and 8, the six rotatable blocks 20 are each in the shape of "T". A pivot joint 21 on one end thereof is pivotally connected to each pin hole 11 of the axle block 10, while a square limiting plate 22 is provided on the opposite end thereof. The bottom of the square limiting plate 22 is arciform.

Figure 9:
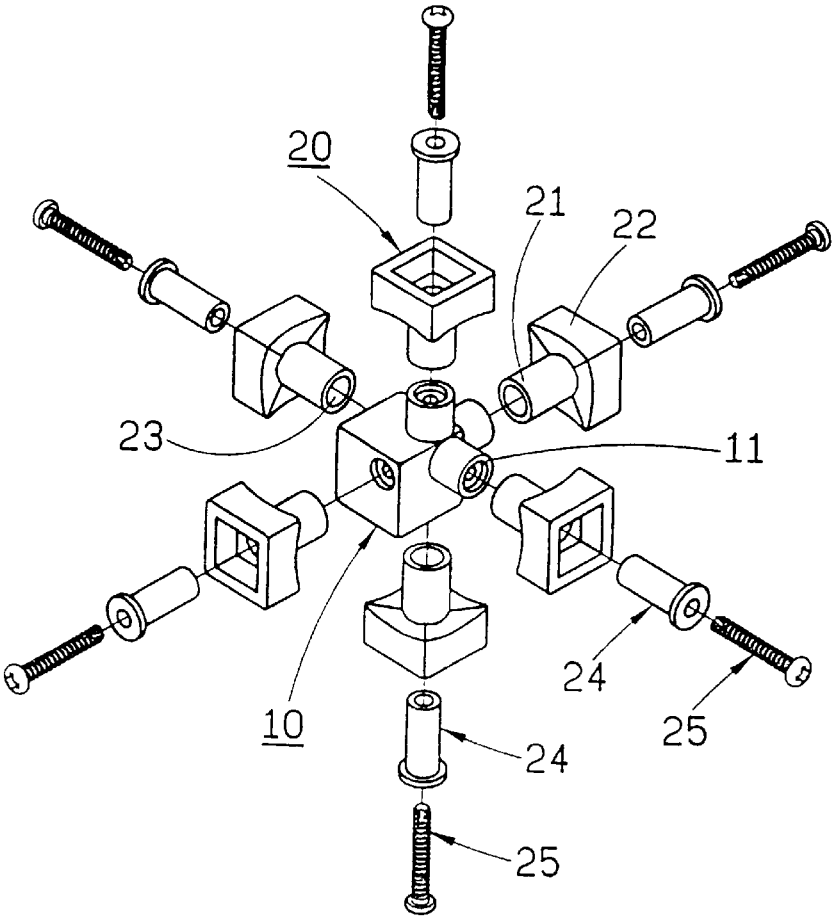
FIG. 9 is a schematic view showing assembling of a plurality of rotatable blocks with the central axle block of the present invention.
Figure 10:
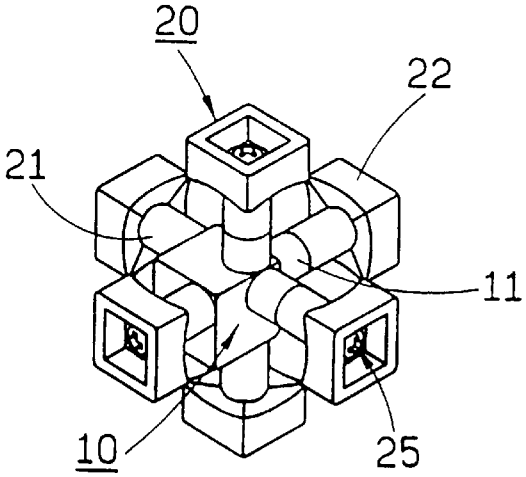
FIG. 10 is a perspective view showing the rotatable block with the central axle blocks of the present invention after assembling.

Referring to FIGS. 9 and 10, the axle block 10 is assembled with the rotatable blocks 20. Such that each of the square limiting plates 22 of the rotatable blocks 20 is drilled to form a throughhole 23 on the tailing end of its corresponding pivot joint 21, and a sleeve 24 with a flange on the outer end thereof is inserted in the through-hole 23, aligning the inner end of the sleeve 24 with a corresponding pin hole 11. A screw 25 is threaded in the sleeve 24 and is fixedly screwed in the pin hole 11, so that the rotatable block 20 is confined on the pin hole 11 but is rotatable about the same.

Figure 11:
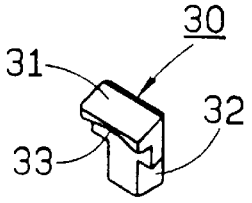
FIG. 11 is a perspective view of a first slidable block of the present invention.
Figure 12:
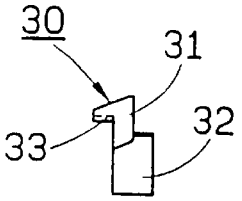
FIG. 12 is a side view of the first slidable block of the present invention.
Figure 16:
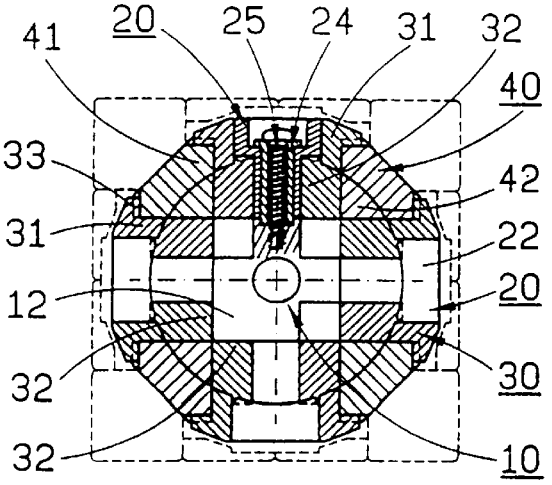
FIG. 16 is a sectional view showing the state after assembling of the first and second slidable blocks with the rotatable blocks and the central axle block of the present invention.

Referring to FIGS. 11 and 12 show the structure of one of the twenty four first slidable blocks 30, which are provided at four sides of all of the six rotatable blocks 20. The top of each of the first slidable blocks 30 forms an abutting portion 31 which abuts one lateral side of the limiting plate 22 of a respective rotatable block 20. The lower portion of the first slidable block 30 is a limiting portion 32 protruding toward a pivot joint 21 of the rotatable block 20 (FIG. 16). The front end of the abutting portion 31 is provided with a flange 33 which is arciform on the bottom thereof. The top of the limiting portion 32 is also arciform and abuts against the arciform bottom of the limiting plate 22, so that the first slidable blocks 30 cannot drop, while the width of the limiting portion 32 is smaller than that of the abutting portion 31, so that both ends of the abutting portion 31 protrude laterally, the bottoms of these ends of the abutting portion 31 are also arciform.

Figure 13:
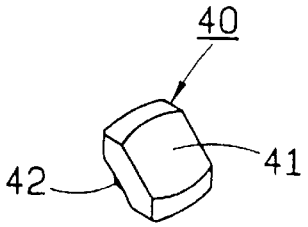
FIG. 13 is a perspective view of a second slidable block of the present invention.
Figure 14:
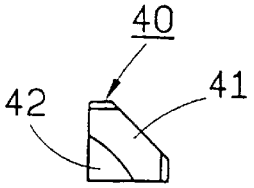
FIG. 14 is a side view of the second slidable block of the present invention.

FIGS. 13 and 14 show the structure of one of the twelve second slidable blocks 40, which are each provided each between two first slidable blocks 30 (FIG. 15), and are triangular in shape, the width of the top of each second slidable block 40 is equal to that of an abutting portion 31 and forms therewith a connecting portion 41. Both ends of the connecting portion 41 are arciform and arranged to about two corresponding arciform bottom surfaces of the flange 33, so that the second slidable block 40 can not drop. The bottom of the second slidable block 40 is provided with a guiding and limiting portion 42 having a smaller width than the connecting portion 41, so that both ends of the connecting portion 41 protrude laterally. The bottoms of these ends of the connecting portion 41 are also arciform so as to abut and conform in shape with the ends of the abutting portion 31, the width of the guiding and limiting portion 42 is equal to that of the limiting portion 32 and abuts thereagainst.

Figure 15:
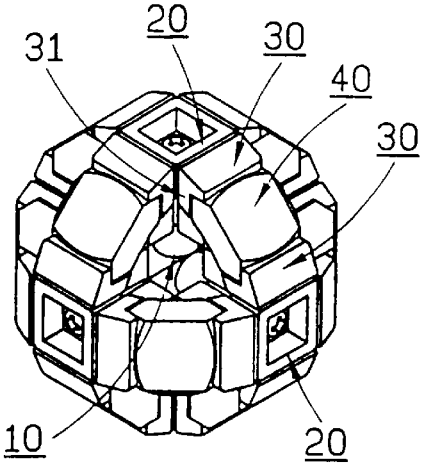
FIG. 15 is a perspective view showing the positions after assembling of a plurality of first and second slidable blocks of the present invention.

FIGS. 15 and 16 show the relationship when assembled of the first slidable blocks 30 and the second slidable blocks 40 with the central axle block 10 and these rotatable blocks 20. As shown in the drawings, the rotatable blocks 20 are assembled to the central axle block 10 and face the six different orientations of a square cube. Each side of each rotatable block 20 which is square is abutted against a first slidable block 30, and a second slidable block 40 is provided between every two first slidable blocks 30 around the rotatable block 20, so that between every two neighboring rotatable blocks 20, there are two first slidable block 30 and one second slidable blocks 40 abutted thereagainst. Taking the top rotatable block 20 shown in the drawings as an example, each side thereof is downwardly abutted against a first slidable block 30, which in turn abuts against a second slidable block 40 which in turn abuts against another first slidable block 30 disposed in an upside down position, while the latter first slidable block 30 also in turn abuts against another rotatable block 20. In other words, the top rotatable block 20 forms a center and is surrounded at the four sides thereof by four first slidable blocks 30, four second slidable blocks 40, the other four first slidable blocks 30, and the other four rotatable blocks 20. The rotatable blocks 20 engage with the first and the second slidable blocks 30, 40 and thus can not drop, but all these members are displaceable, therefore. Therefore slidable blocks 30, 40 and the four rotatable blocks 20 surrounding the central axle block 10 can be revolved therearound and change their positions. It is the same situation when taking another rotatable block 20 as a center. This is the interior structure of the four-layer intellectual cube B.

Figure 17:
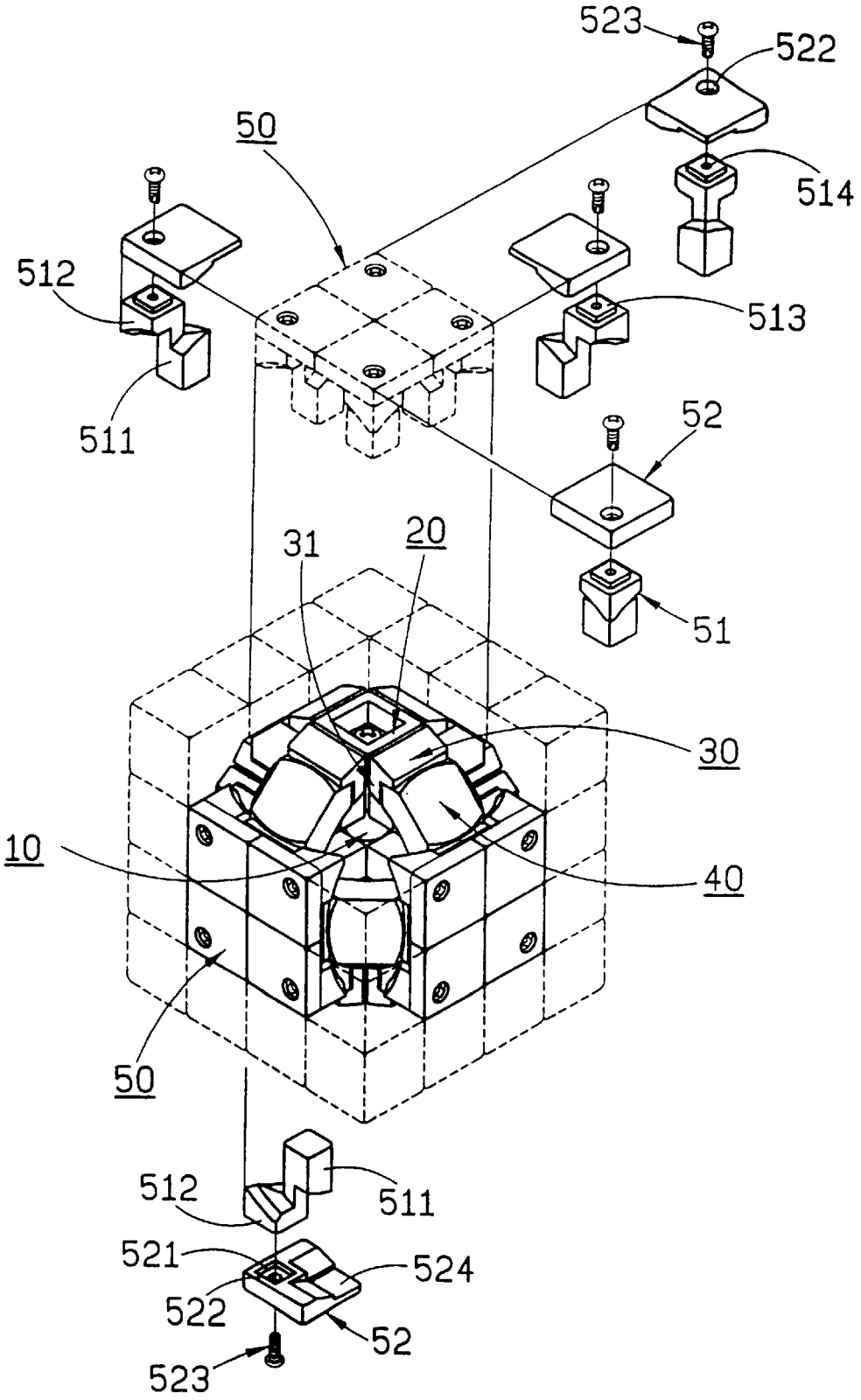
FIG. 17 is an analytic perspective schematic view showing the structure and the positions of the central movable units of the present invention.

FIG. 17 shows the structure of twenty four central movable units 50. Each central movable unit 50 is comprised of an inner slide block 51 and an outer slide plate 52. The inner slide blocks 51 are positioned at the four corners of the rotatable blocks 20, i.e., positioned each between two of the four first slidable blocks 30 in the circumference of a rotatable block 20 (FIGS. 15, 17), are each displaceable together each with the left or right neighboring first slidable block 30 thereof, and are each in the shape of "Z". The lower portion of the inner slide block 51 is a lower guiding and limiting portion 511 which is placed under the abutting portion 31 of a first slidable block 30. The upper portion thereof is an upper guiding and limiting portion 512, the top of which is extended slightly over the top of the abutting portion 31 of the first slidable block 30 and is provided with an upwardly raised fixing portion 513 which is excavated to form a screw hole 514. The outer slide plate 52 is in the shape of a thin sheet having a square top surface. Four outer slide plates 52 are assembled into a set which forms the four central movable units 50 of each side of the four-layer intellectual square cube. The bottom of the outer slide plate 52 is provided with a groove 521 and a fixing hole 522 corresponding to the fixing portion 513 of the inner slide blocks 51. The groove 521 is engaged with the fixing portion 513, and a tiny screw 523 extends through the fixing hole 522 and the screw hole 514 for securing the outer slide plate 52 on the inner slide blocks 51. Therefore when the inner slide blocks 51 are displaced, the outer slide plate 52 is displaced therewith. Further, the outer slide plate 52 is provided on the bottom thereof with a depressed portion 524 to prevent the outer slide plate 52 from collision or interference by the rotatable block 20, the first slidable block 30 and the second slidable blocks 40.

Figure 18:
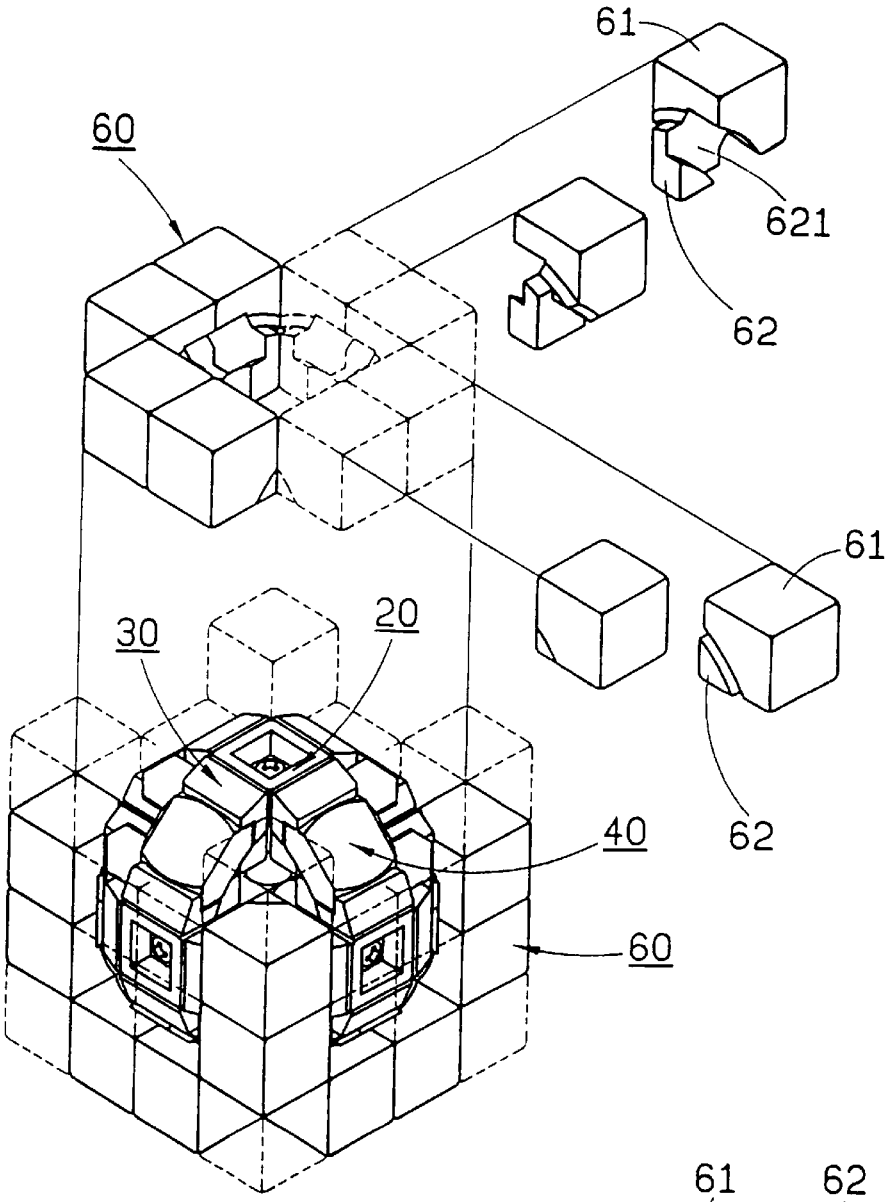
FIG. 18 is an analytic perspective schematic view showing the structure and the positions of the edge movable units of the present invention.
Figure 19:
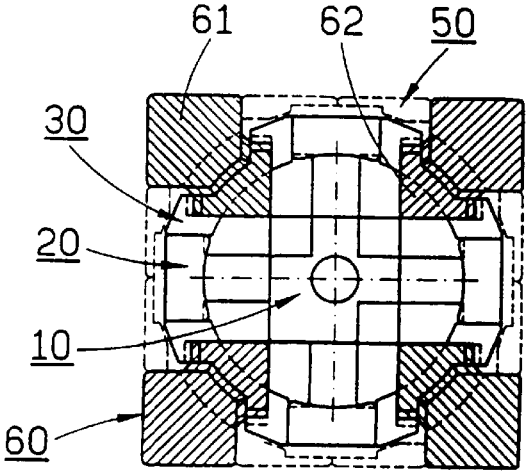
FIG. 19 is a schematic view showing the positions of the edge movable units of the present invention.

FIGS. 18 and 19 show the structure of a plurality of edge movable units 60 which are provided on the edges of every side of the four-layer intellectual square cube, a pair on each edge, and surround the four central movable units 50 on each side. These edge movable units 60 amount to twelve pairs, i.e., twentyfour individuals. Each edge movable unit 60 is comprised of an inner and an outer portion 62, 61. The outer portion 61 is square, while the inner portion 62 is triangular and is extended inwardly to the lateral sides of the first slidable blocks 30 and the second slidable blocks 40 neighboring therewith, and is excavated to form a lateral arciform slide groove 621 conforming in shape to the abutting portions 31 and the connecting portions 41 provided on the tops of the first slidable blocks 30 and the second slidable blocks 40 (FIG. 16). As a result the bottom of the inner portion 62 is restrained and does not drop, but it can slide along the arciform bottoms of the abutting portions 31 and the connecting portions 41.

Figure 20:
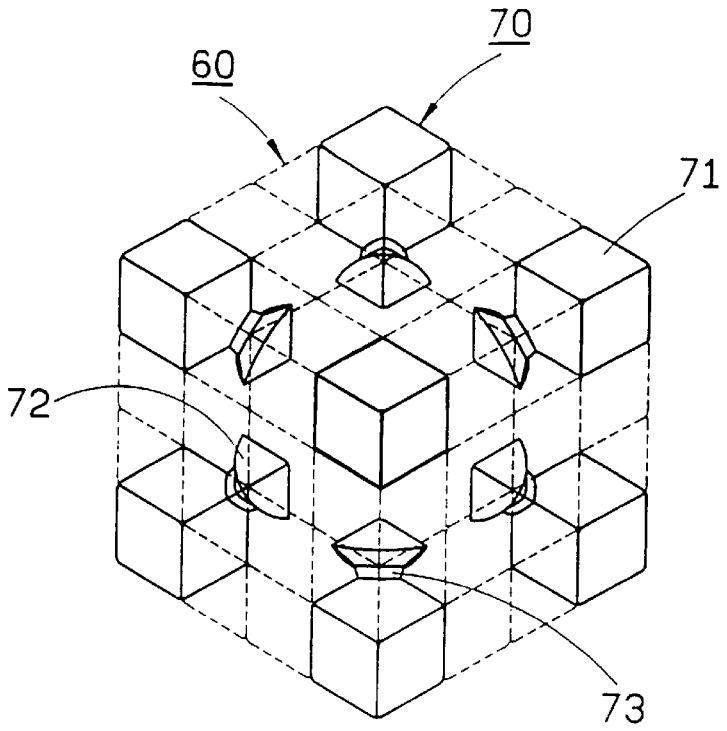
FIG. 20 is a perspective schematic view showing the positions of the corner movable units of the present invention.
Figure 21:
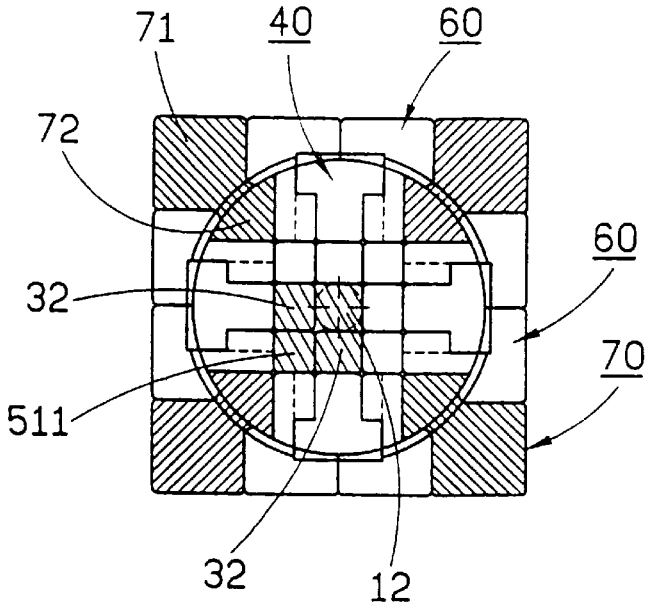
FIG. 21 is a schematic view showing the positions of the corner movable units and a seat block of the present invention.

FIGS. 20 and 21 show the structure of the eight corner movable units 70 which form the eight corners of the fourlayer intellectual square cube. Each corner movable unit 70 is comprised of an outer square portion 71 and an inner triangular portion 72. The inner triangular portion 72 is engaged in the gap formed by three edge movable units 60 neighboring therewith so that the inner triangular portion 72 is restrained and will not drop. The top of the inner triangular portion 71 is arciform and can therefore be moved together with any of the mentioned three edge movable units 60 neighboring therewith. The arciform top surface of the inner triangular portion 72 is connected to the inner corner of the outer square portion 71 by a connecting portion 73 provided therebetween to increase the strength of the connection.

Figure 22:
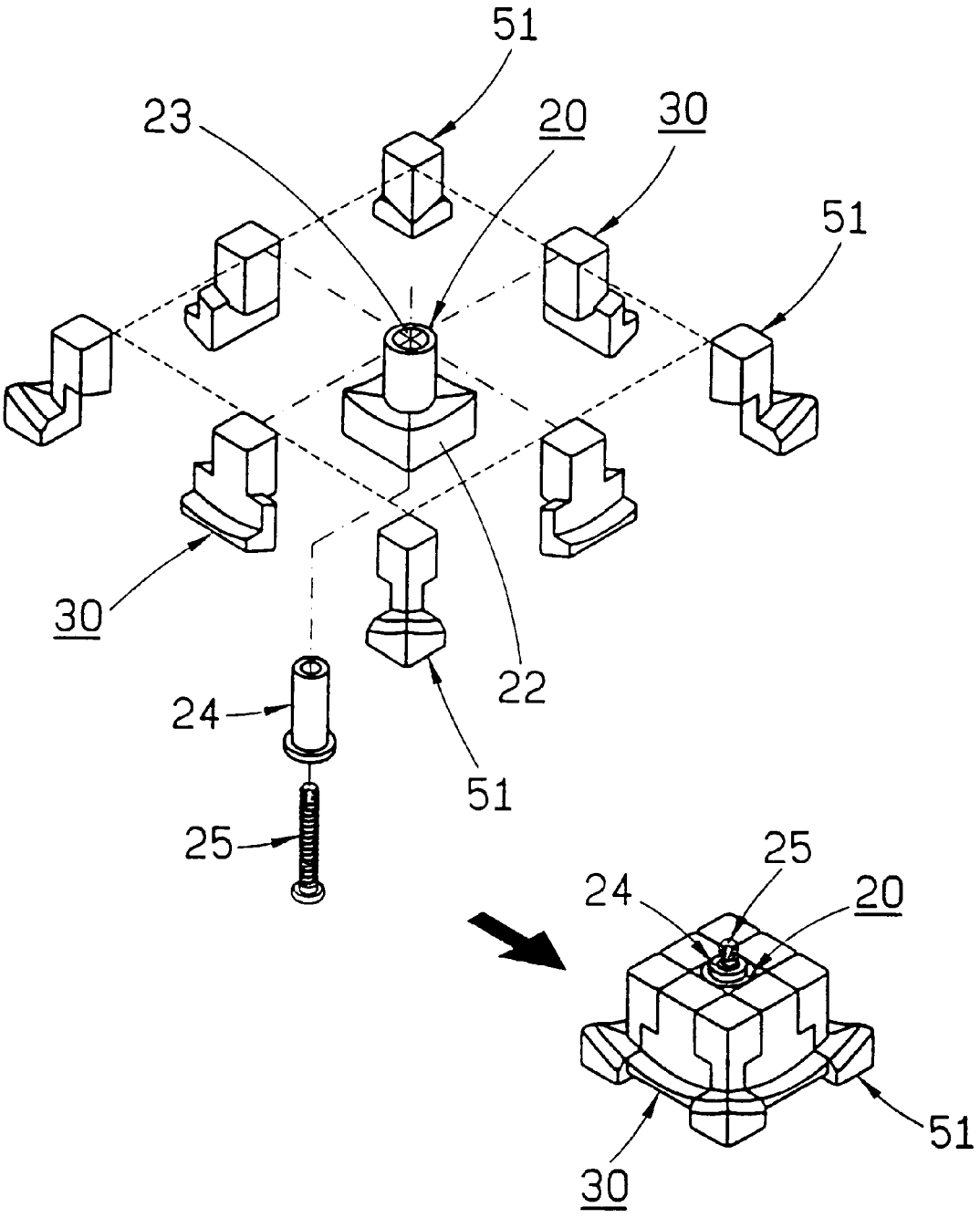
FIG. 22 is an analytic perspective schematic view showing the first step of assembling of the present invention.

The above description concerns the structure and the relation of connection of the components of the four-layer intellectual square cube. To assemble the cube, the rotatable blocks 20 which are the innermost and the first limiting members are assembled first, and the outer slide plates 52 of the central movable unit 50 are assembled last in order to restrain all the components. More specifically, the assembling work shall be done according to the steps shown in FIGS. 22 to 34 as follows:

As shown in FIG. 22, during in assembling, the limiting plate 22 of a rotatable block 20 faces down, and a sleeve 24 and a screw 25 are extended through a roughhole 23 therein. Then, four first slidable blocks 30 and four inner slide blocks 51 are abutted thereon respectively on the four sides and the four corners thereof to form a small square block. This is the first step in assembling.

Figure 23:
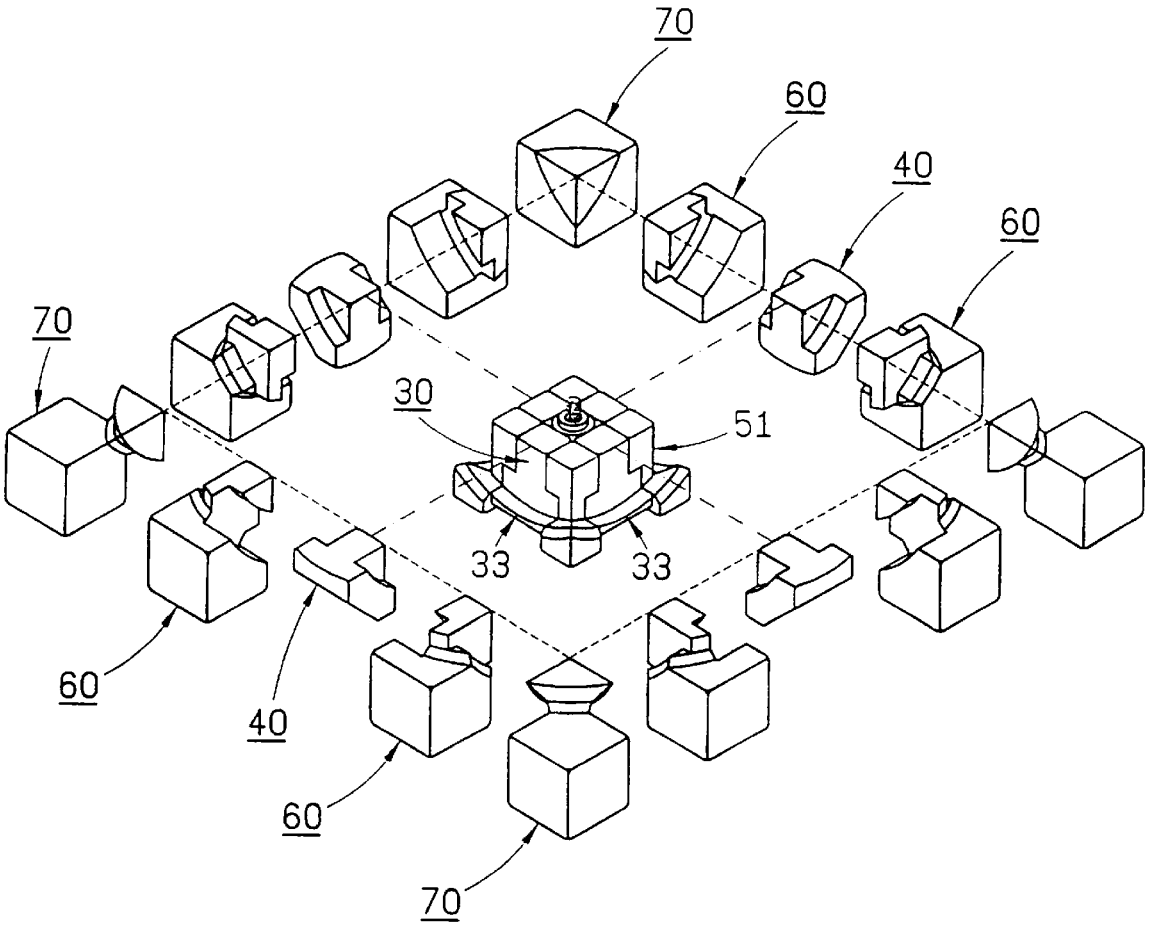
FIG. 23 is an analytic perspective view showing the second step of assembling of the present invention.
Figure 24:
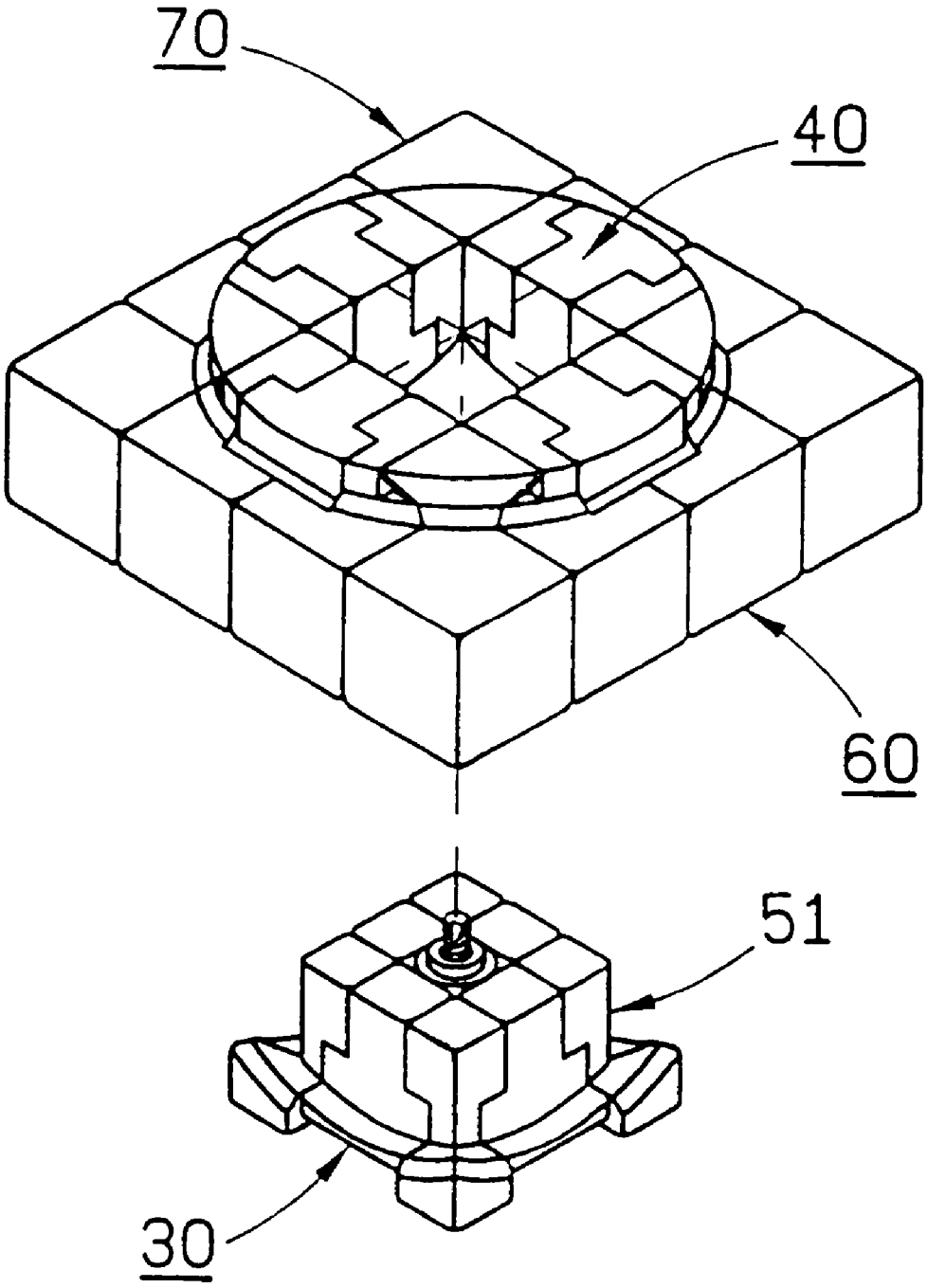
FIG. 24 is a schematic view showing the second step of assembling of the present invention.

As shown in FIGS. 23 and 24, after completion of the above-described steps, four second slidable blocks 40 are assembled respectively on the flanges 33 of the four first slidable blocks 30, and then eight edge movable units 60 and four corner movable units 70 are mounted on the laterals and corners of the four second slidable blocks 40 respectively. This is the second step in assembling.

Figure 25:
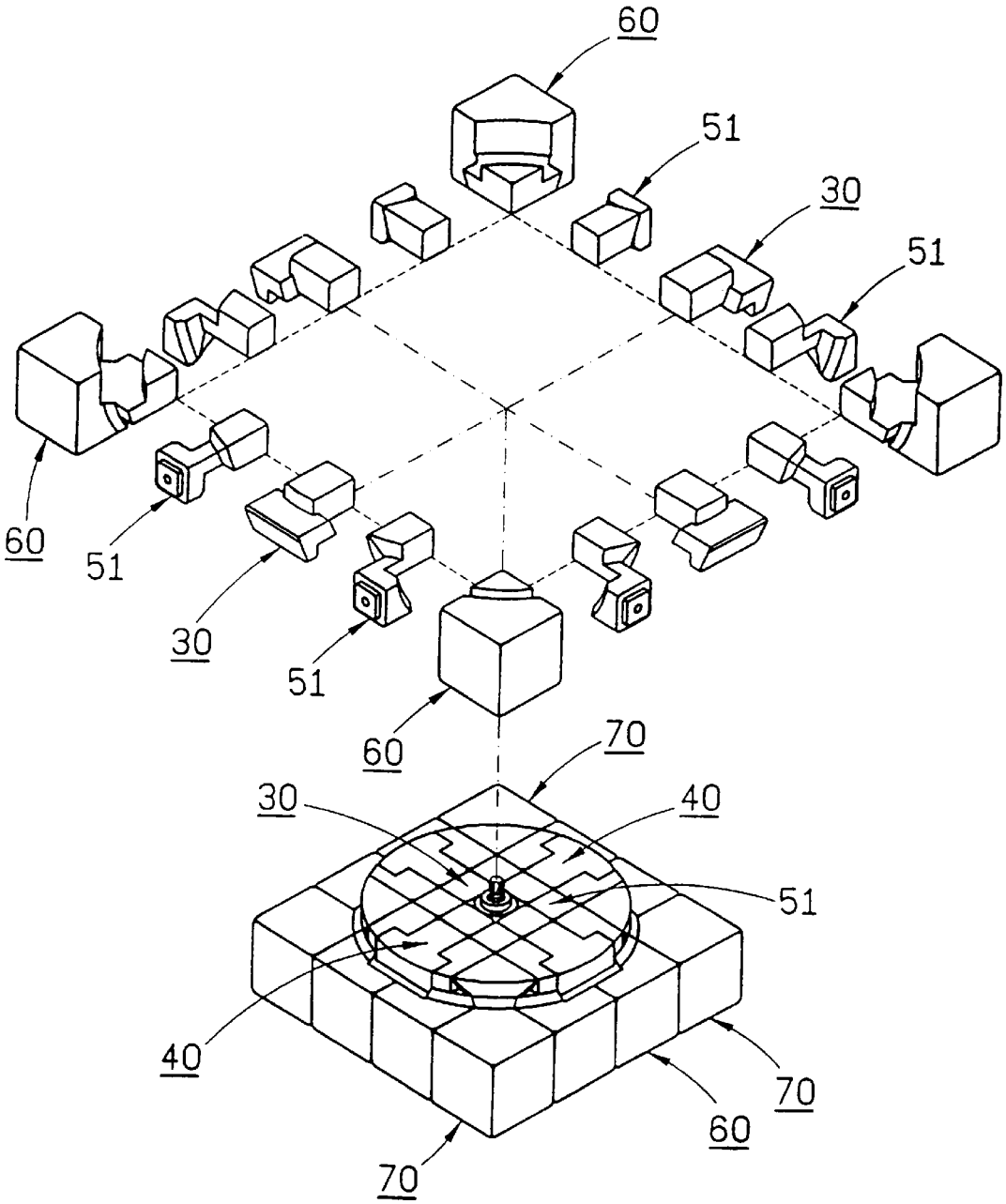
FIG. 25 is an analytic perspective view showing the third step of assembling of the present invention.
Figure 26:
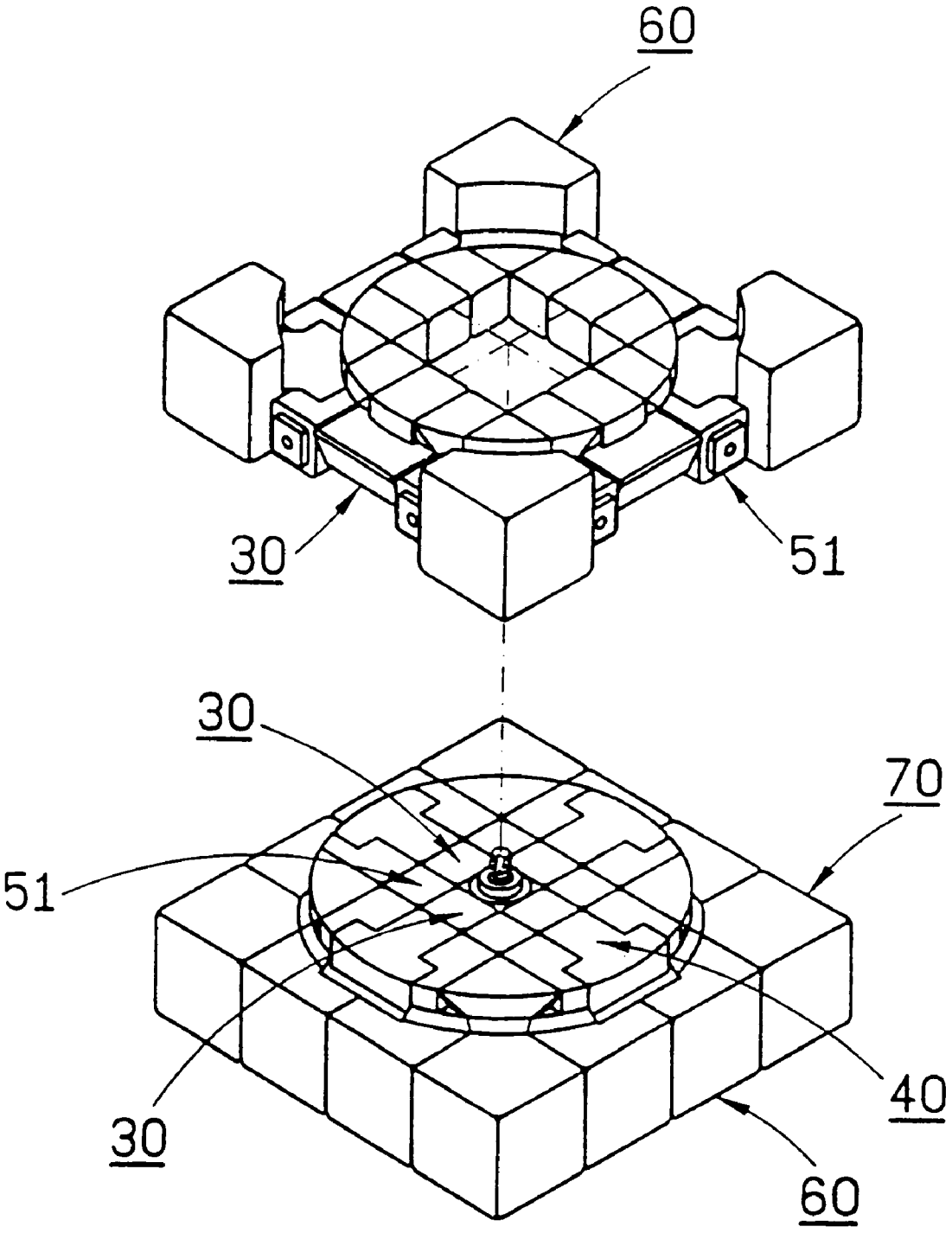
FIG. 26 is a schematic view showing the third step of assembling of the present invention.

As shown in FIGS. 25 and 26, after completion of the above stated assembling steps, the bottom layer of the four-layer intellectual square cube is completed except the outer slide plates 52. In the completed bottom layer at this time, four first slidable blocks 30 are mounted on the four second slidable blocks 40, and then eight inner slide blocks 51 are mounted so that every lateral side of the first slidable blocks 30 just mounted is next to an inner slide block 51, after which the other four edge movable units 60 are superimposed on the four corner movable units 70. This is the third step in assembling, and completes the second layer of the four-layer intellectual square cube.

Figure 27:
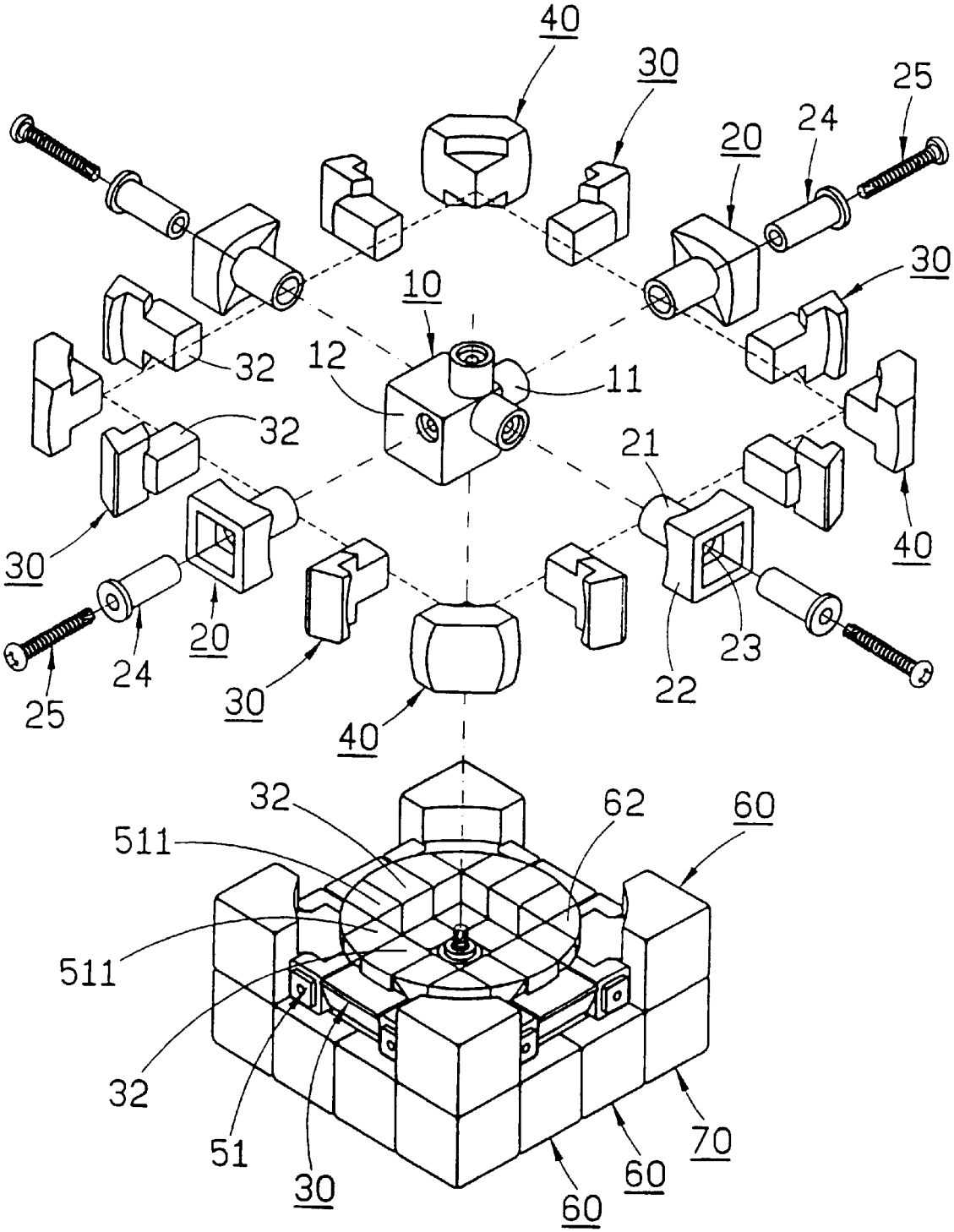
FIG. 27 is an analytic perspective view showing the fourth step of assembling of the present invention.
Figure 28:
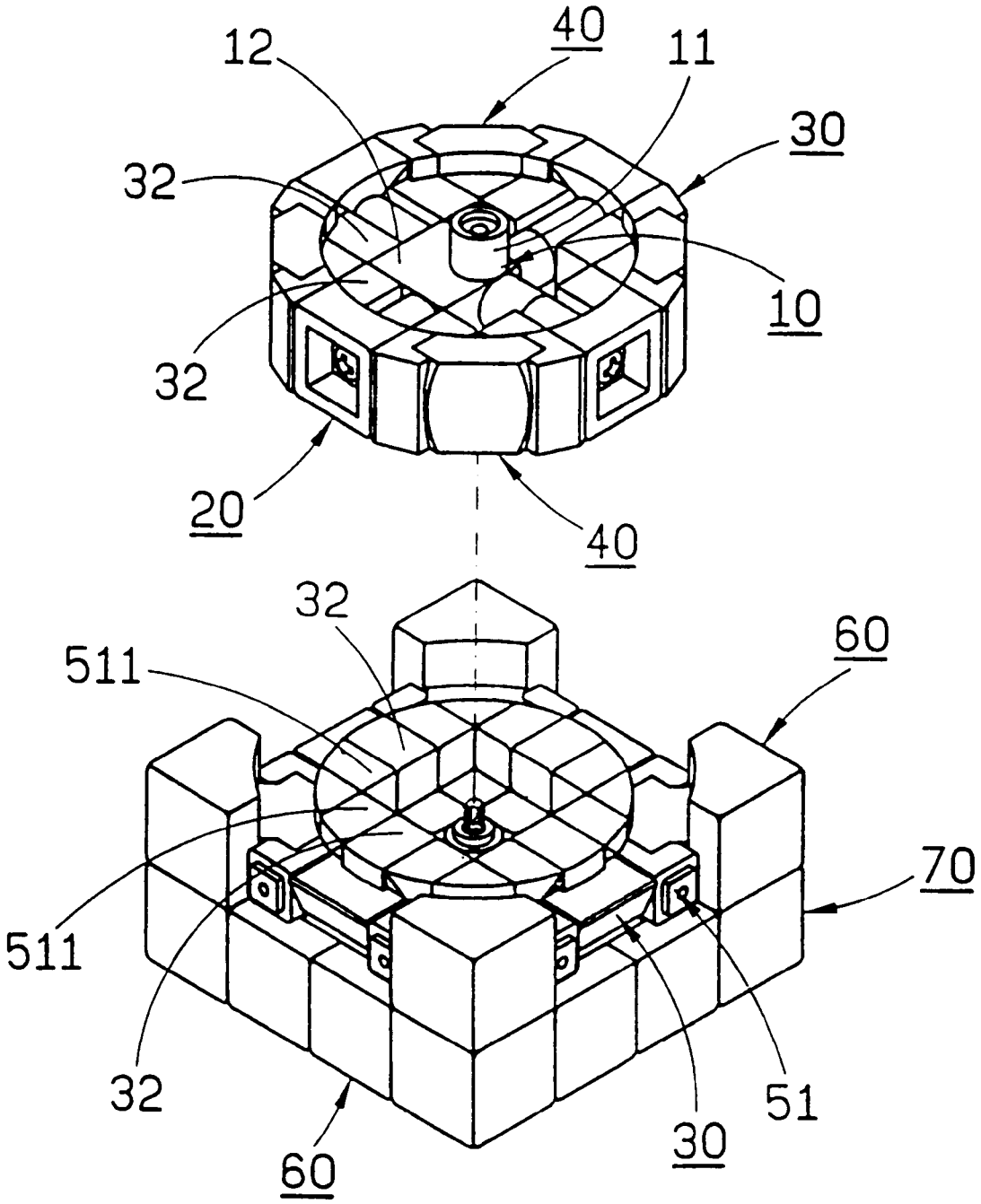
FIG. 28 is a schematic view showing the fourth step of assembling of the present invention.

As shown in FIGS. 27 and 28, after completion of the third assembly step, the central area of the second layer has a depressed contour, so that the screw 25 extending through the pivot joint 21 of the bottom rotatable block 20 protrudes. In the fourth step of assembling, the pin hole 11 on the bottom of the axle block 10 is threadedly connected with the screw 25, so that the rotatable block 20 is pivotally connected to the bottom of the axle block 10, at which time the other pin holes 11 of the axle block 10 face the other five orientations corresponding to those of the other five sides of the four-layer intellectual square cube with six sides. Then four further second slidable blocks 40 are mounted respectively on the inner portions 62 of the four edge movable units 60 on the second layer, eight first slidable blocks 30 are mounted so that every lateral side of the second slidable blocks 40 is next to one of the first slidable blocks 30 which amount to eight here, and lastly, four rotatable blocks 20 are mounted along every pin hole 11 in a horizontal plane, each in a space between two first slidable blocks 30, completing the fourth assembly step.

Figure 29:
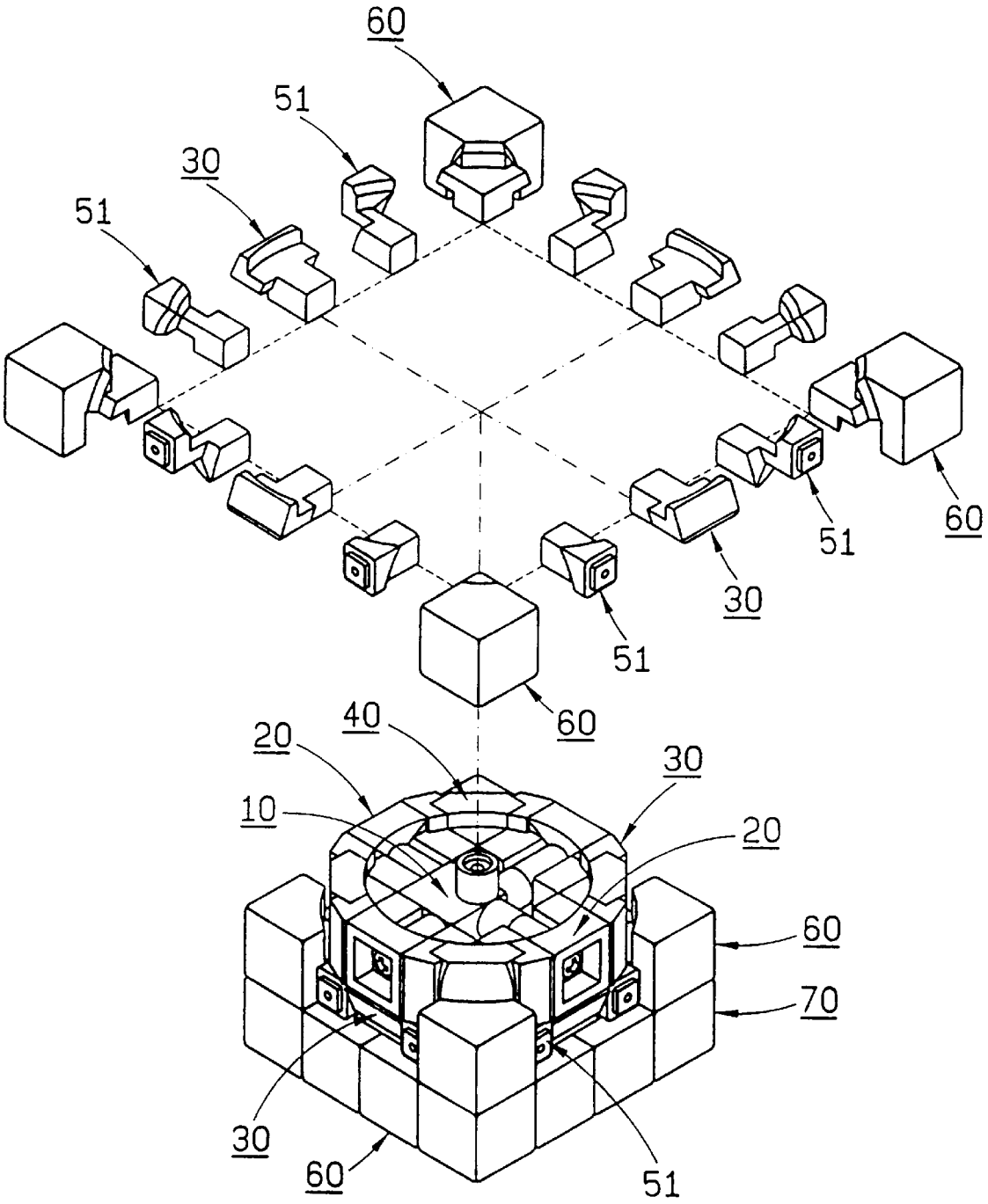
FIG. 29 is an analytic perspective view showing the fifth step of assembling of the present invention.
Figure 30:
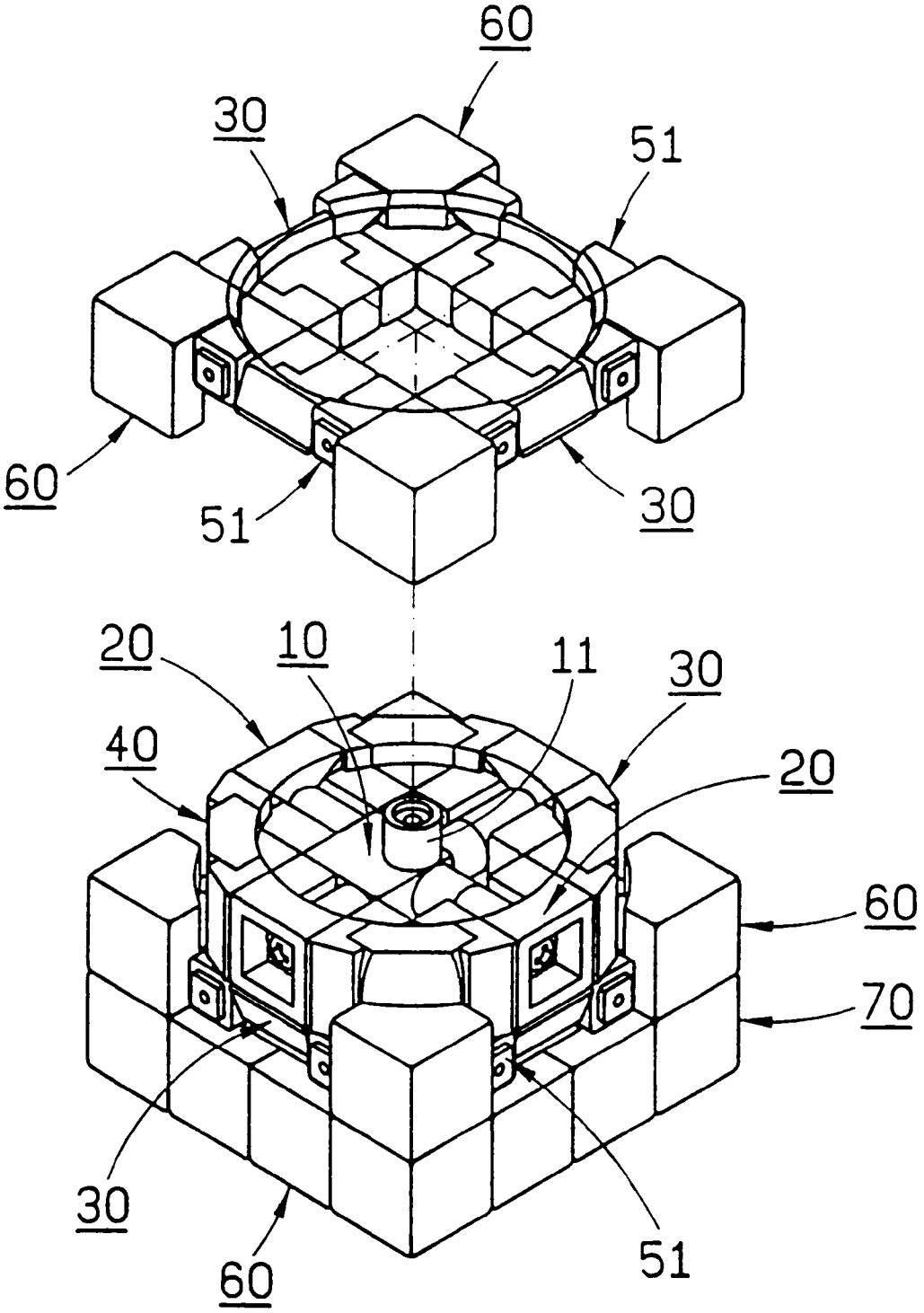
FIG. 30 is a schematic view showing the fifth step of assembling of the present invention.

As shown in FIGS. 29 and 30, following completion of the fourth step of assembling, the central area of the second layer has a protruding contour. The fifth step is similar to the third step, but is carried out with the members upside down, that is, four edge movable units 60 are initially respectively located in position on the four edge movable units 60 of the second layer, eight inner slide blocks 51 are respectively placed at both the lateral sides of these edge movable units 60, and four first slidable blocks 30 are placed each between one of four pairs of the inner slide blocks 51 on the four edges, thus completing assembly the fifth step, and thereby also completing the third layer of the four-layer intellectual square cube.

Figure 31:
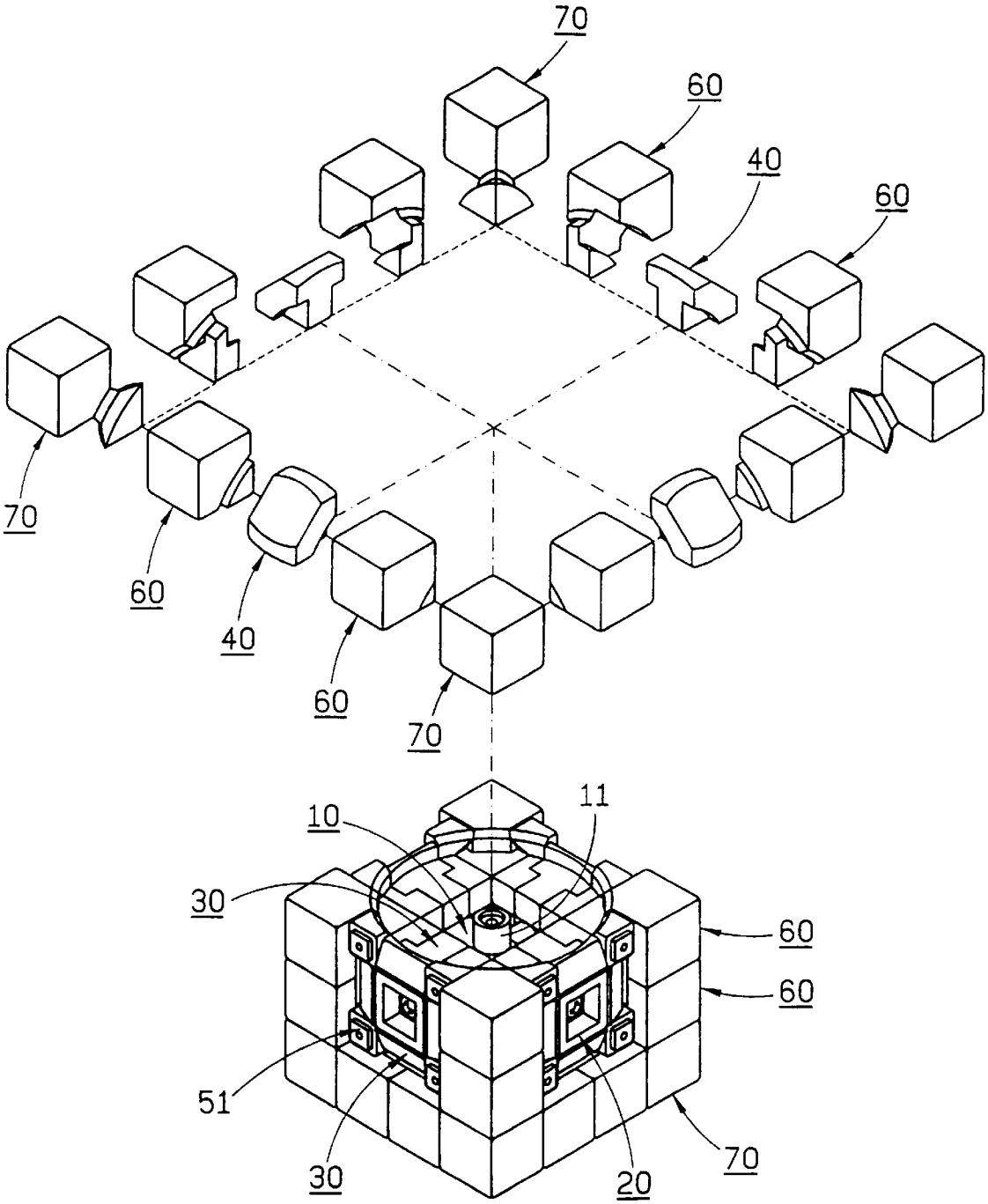
FIG. 31 is an analytic perspective view showing the sixth step of assembling of the present invention.
Figure 32:
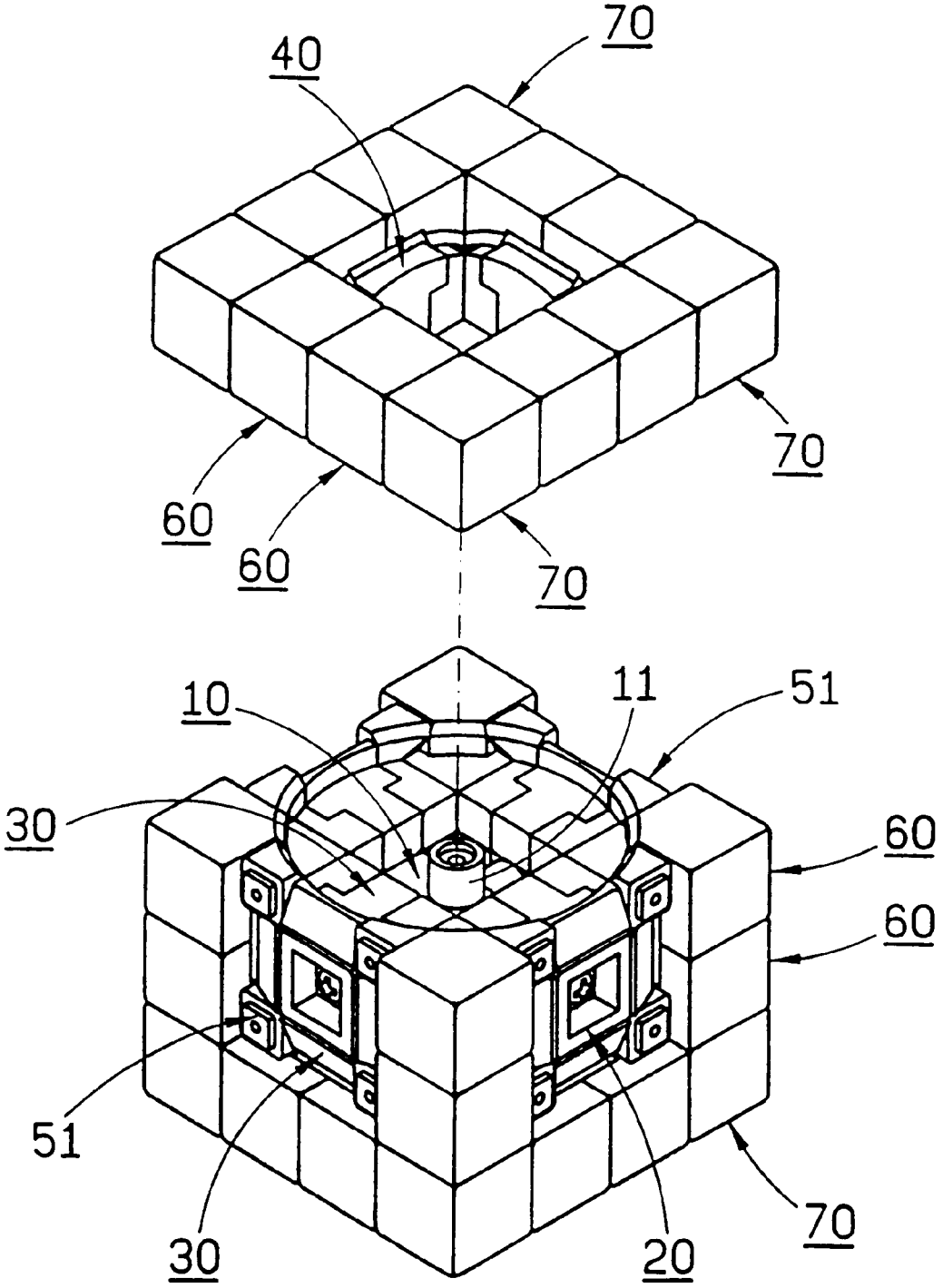
FIG. 32 is a schematic view showing the sixth step of assembling of the present invention.

As shown in FIGS. 31 and 32, after completion of the third layer, the sixth step can be performed to assemble the top layer. The members in the top layer are the same as those in the bottom layer but with the members being upside down as compared with the case of the second layer. That is to say, the four corner movable units 70 are located on the four corners, and eight edge movable units 60 are mounted so that every lateral side of the four corner movable units 70 is adjacent an edge movable unit 60. Four second slidable blocks 40 are each mounted between the slide grooves 621 of two edge movable units to complete the sixth assembly step, thereby, completing the top layer of the four-layer intellectual square cube is completed.

Figure 33:
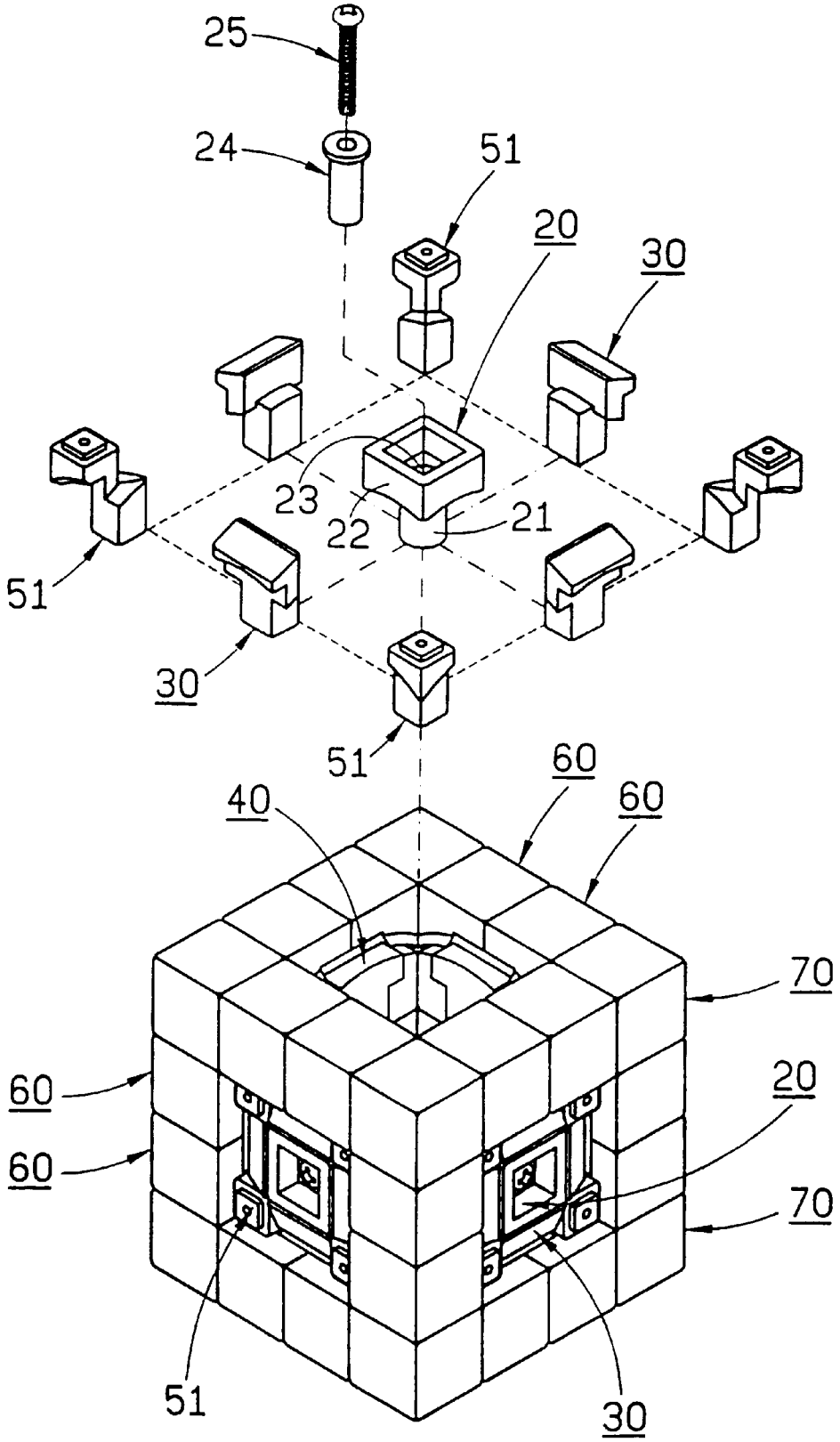
FIG. 33 is an analytic perspective view showing the seventh step of assembling of the present invention.
Figure 34:
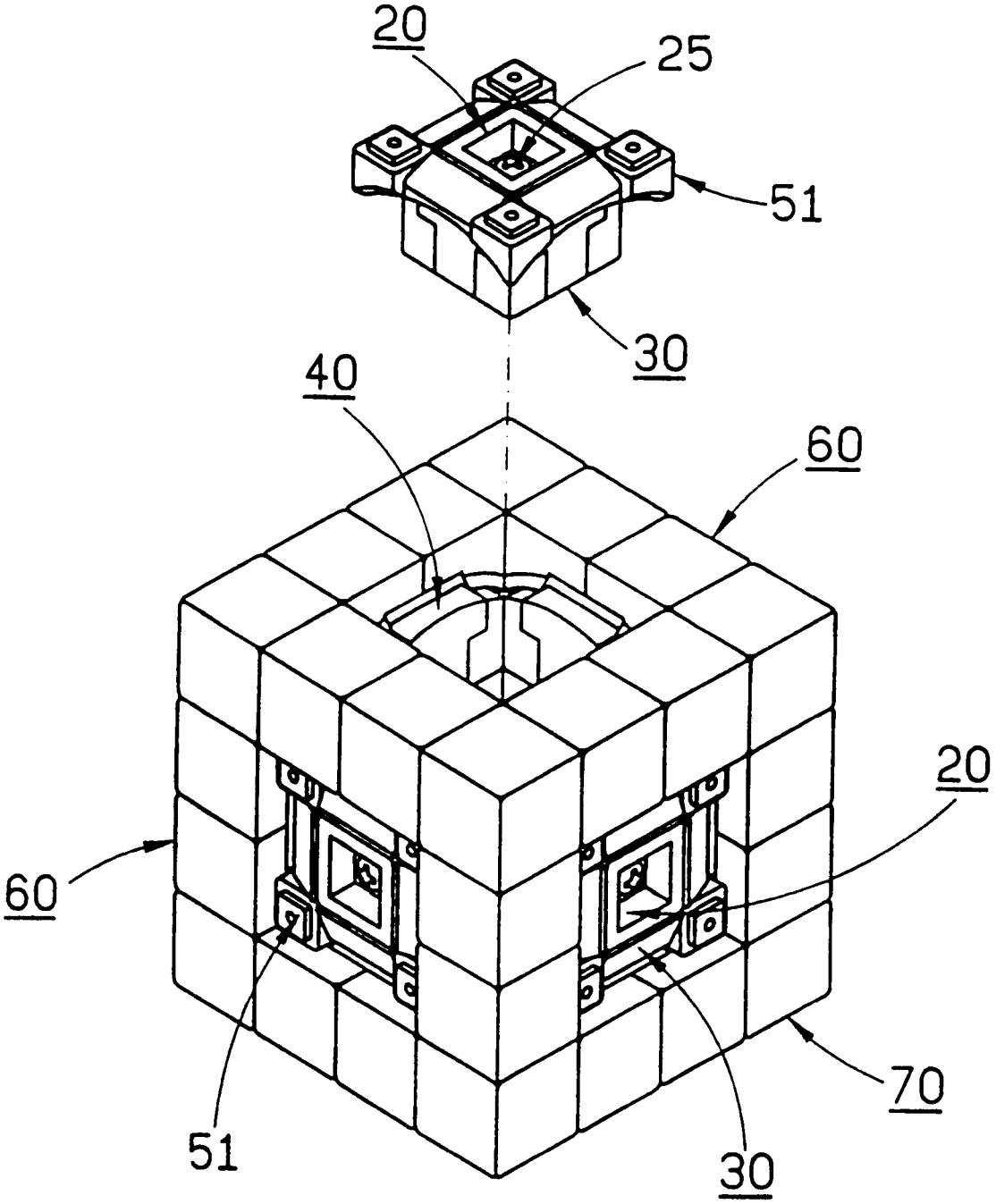
FIG. 34 is a schematic view showing the seventh step of assembling of the present invention.

As shown in FIGS. 33 and 34, after completion of the top layer of the four-layer intellectual square cube, due to the fact that the top pin hole 11 of the axle block 10 has not yet been assembled with a rotatable block 20 and the surrounding members thereof when assembling the third layer and the top layer, the top members being only abutted against one another rather than are limited in position. In addition, the central area is depressed. Consequently the seventh assembly step involves mounting on the central area of the top layer the same members as those in the first step, except that the members are upside down, i.e., the top pin hole 11 is taken as a center, four first slidable blocks 30 and four inner slide blocks 51 are abutted thereon respectively on the four sides and the four corners thereof, and the pivot joint 21 of the last rotatable block 20 is directed downwardly. Then a sleeve 24 and a screw 25 are extended through a throughhole 23 thereon, so that the rotatable block 20, the first slidable blocks 30 and the inner slide blocks 51 are abutted thereon on the four sides and the four corners thereof respectively to form a small square block which is placed in the above mentioned depressed central area. The screw 25 is threadedly connected with the top pin hole 11 of the axle block 10 and the limiting plate 22 of the rotatable block 20 is located at the center. The above-described members assembled in the preceding steps can be engaged one after another by the limiting plate 22, and the seventh step in assembling thus is completed.

Figure 35:
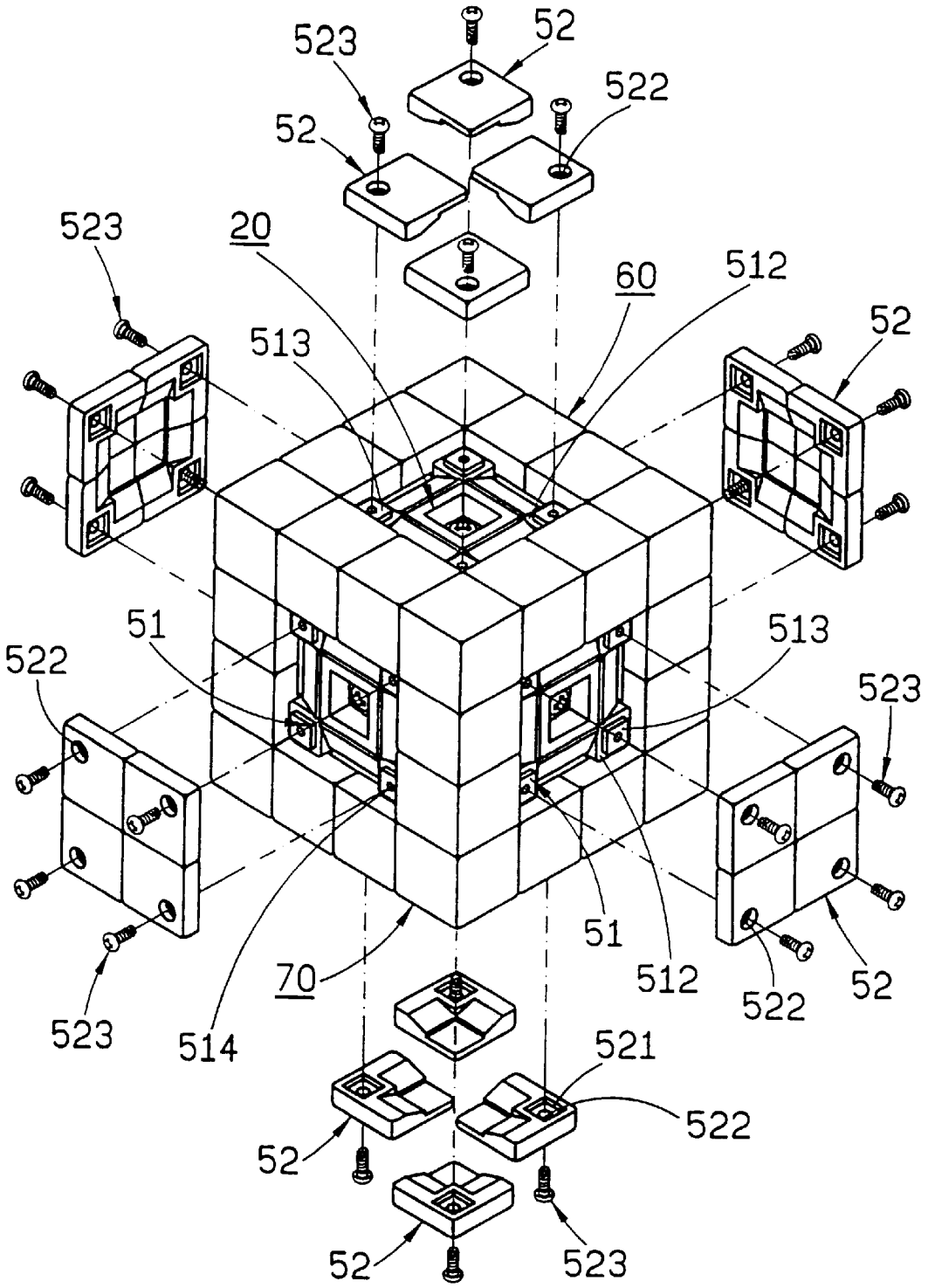
FIG. 35 is an analytic perspective view showing the eighth step of assembling of the present invention.
Figure 36:
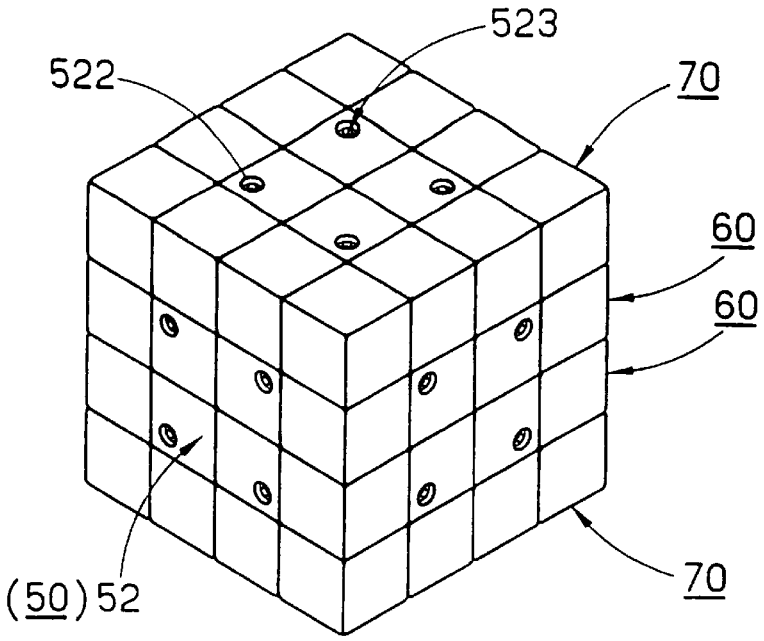
FIG. 36 is a schematic view showing the eighth step of assembling of the present invention.

As shown in FIGS. 35 and 36, following completion of the seventh assembly step, the four-layer intellectual square cube is completed except that the outer slide plates 52 of all of the central movable units 50 are not yet assembled, although all kinds of the movable units on the surfaces thereof can already be displaced to change their positions. The eighth step is performed to extend each of a plurality of tiny screws 523 through a fixing hole 522 of an outer slide plate 52 to be,secured on a fixing portion 513 of an upper guiding and limiting portion 512 on the top of an inner slide block 51, so that assembling of the central movable units 50 is completed, the appearance of the four-layer intellectual square cube is neat, and every side thereof can be varied by displacement to change the positions of the movable units therein.

Figure 37:
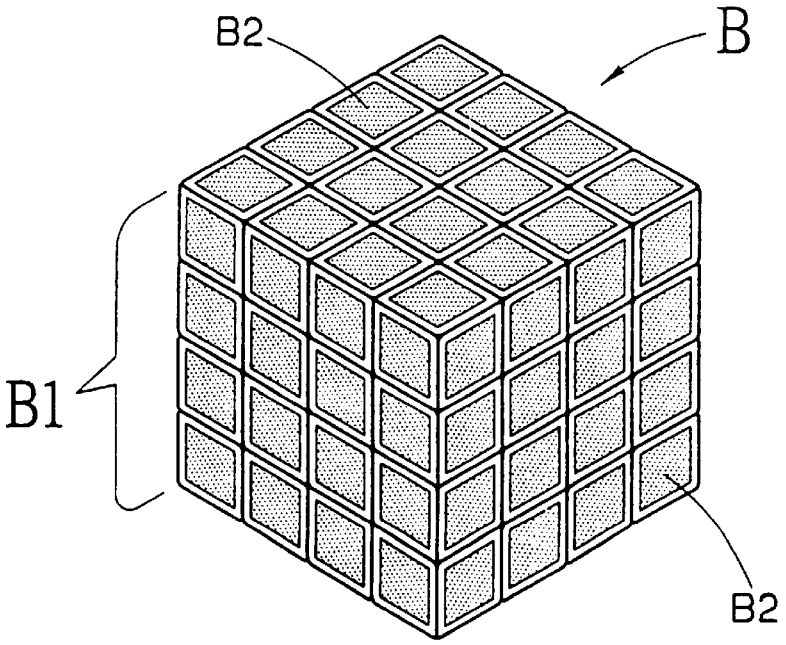
FIG. 37 is a schematic view showing the ninth step of assembling of the present invention.

As shown in FIG. 37, the last step of the present invention is to provide various colors or patterns for the six sides B1 of the four-layer intellectual square cube B1. In order to prevent the tiny screws 523 and the fixing holes 522 from destroying the neat appearance of the whole cube B, sticking papers B2 of various colors and/or patterns can be stuck to the multiple movable units, and the assembling of the whole cube B thus is completed.

Figure 1:
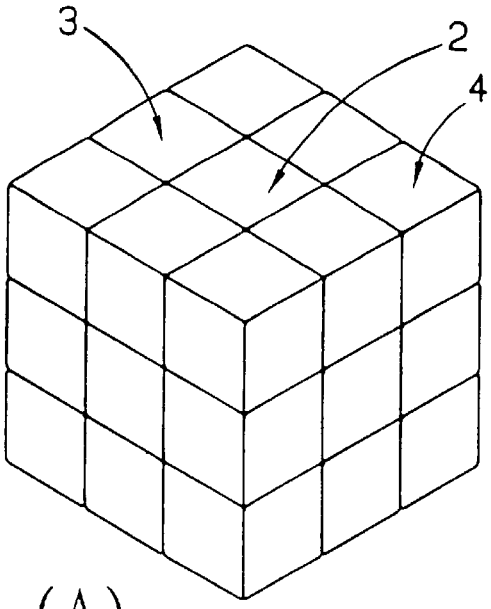
Fig. 1 PRIOR ART
FIG. 1 is a perspective view of a conventional three-layer intellectual square cube.
Figure 2:
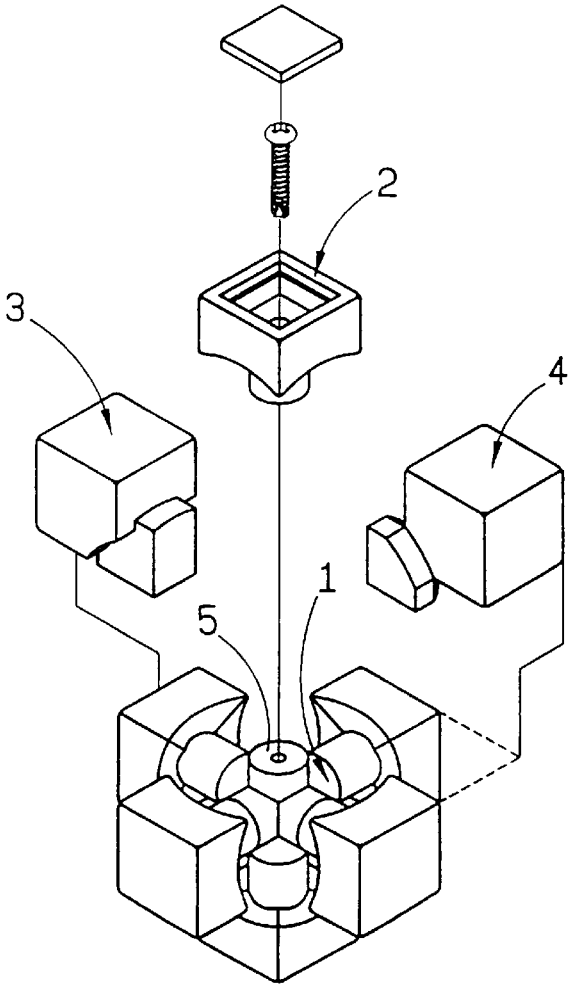
Fig. 2 PRIOR ART
FIG. 2 is a structural perspective view of the conventional three-layer intellectual square cube.

The function of the above mentioned seat block 12 of the axle block 10 shown in FIG. 5 has to be explained here: because the fact that a conventional three-layer intellectual cube is a three-layer structure, no matter which layer is rotated, the cross shaped central axle block 1 (FIGS. 1, 2) is moved synchronically with the middle layer. However, the four-layer intellectual cube is a four-layer structure and does not have a middle layer as is the case in a conventional three-layer intellectual cube. Therefore, when the two middle layers thereof are rotated relatively, such as are shown in FIGS. 4 (*b*) and (*c*), by virtue of the fact that the central axle block 10 is located between the two middle layers (FIG. 16), if the axle block 10 does not rotate with any of the middle layers, when these two middle layers rotate relatively with each other by 90 degrees, the central axle block 10 is rotated only for any angle between 0–90 degrees. Consequently after the middle layers of the four-layer intellectual cube are rotated, the central axle block 10 will deviate, and when the four-layer intellectual cube is to be rotated in the direction as shown in FIG. 4 (*d*), the whole interior structure thereof (such as is shown in FIG. 15) will be positionally in a mess, and stuck to one another, so that the whole four-layer intellectual cube is inoperable. Therefore, when the two middle layers rotate relatively with each other, structurally, the central axle block 10 must be rotated together with one of the two middle layers. Practically, the seat block 12 is the member necessary to allow the central axle block 10 to be rotated together with one of the two middle layers. The relative relation of the seat block 12 with other members is shown respectively in FIGS. 16, 21, 27 and 28. Because the the seat block 12 is a small cube and envelops the center of the central axle block 10 with one corner thereof, the opposite corner thereof being eccentric, the eccentric corner causes the six sides of the cube B to abut against the lower guiding and limiting portions 511 of the central movable units 50 and the limiting portions 32 of the first slidable blocks 30, so that the central axle block 10 keeps its eccentric positional relation. When the two middle layers of the whole four-layer intellectual cube rotate relatively to each other, the seat block 12 keeps stationary with one of the two middle layers, while the other of the middle layers is rotated relatively thereto.

Figure 38:
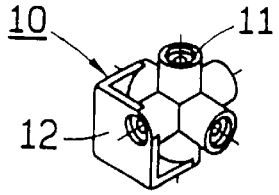
FIG. 38 is a perspective view of the first embodiment of the central axle block of the present invention.
Figure 39:
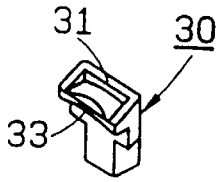
FIG. 39 is a perspective view of a first slidable block of the present invention.
Figure 40:
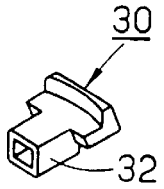
FIG. 40 is a perspective view showing clockwise rotation for 90 degrees of the first slidable block of the present invention.
Figure 41:
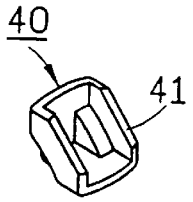
FIG. 41 is a perspective view of a second slidable block of the present invention.
Figure 42:
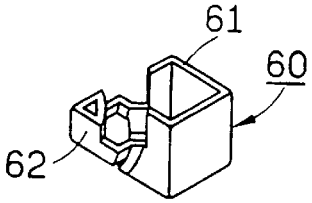
FIG. 42 is a perspective view of an edge movable unit of the present invention.
Figure 43:
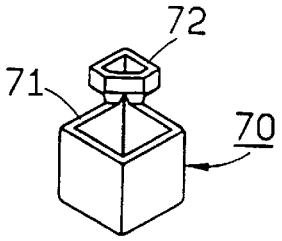
FIG. 43 is a perspective view of a corner movable unit of the present invention.

The names and the shapes illustrated for the above mentioned members are only for convenience of describing the structure of the present invention, and not for giving any limitation to the scope of the present invention. It will be apparent to those skilled in this art that various modifications or changes can be made to the elements of the present invention with the same result. For example:

FIGS. 38 to 43 show that the above stated members are made by plastic injection moulding, and that to prevent reducing of weight of the plastisol after shrinking by cooling, all the blocks of the members are excavated to be hollow. FIG. 38 shows the seat block 12 of the axle block 10 being excavated, and FIG. 39 shows an abutting portion 31 of a first slidable block 30 being excavated on the top thereof. FIG. 40 shows a limiting portion 32 of a first slidable block 30 being excavated on the bottom thereof, FIG. 41 shows a connecting portion 41 of a second slidable block 40 being excavated on the top thereof FIG. 42 shows the interior of an edge movable unit 60 being excavated, and FIG. 43 shows the interior of a corner movable unit 70 being excavated. Further, during manufacturing, all the members are provided with rounded edges to facilitate displacing.

Figure 44:
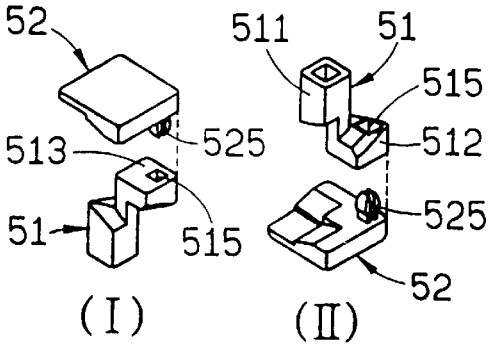
FIG. 44 includes two perspective views showing assembling of an inner slidable block and an external plate of a central movable unit respectively of the present invention.

FIGS. 44 (I) and (II) are two perspective views showing assembling of an inner slidable block 51 and an external plate 52 of a central movable unit 50, respectively, of the present invention. In the drawing, the lower guiding and limiting portions 511 of the inner slidable block 51 are excavated to be hollow, the fixing portion 513 of the upper guiding and limiting portion 512 is excavated to form a square hole 515, and an engaging portion 525 is extended down from the bottom of the external plate 52 and is opposite to the square hole 515, the engaging portion 525 being engaged in the square hole 515 to complete assembling of the inner slidable block 51 and the external plate 52.

Figure 45:
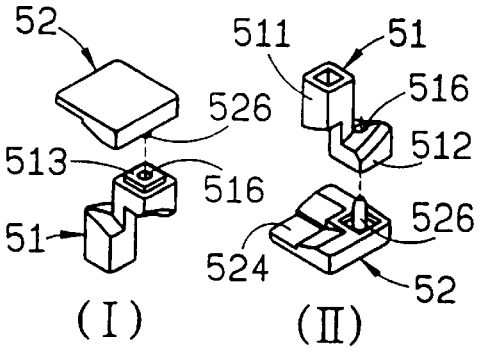
FIG. 45 includes two perspective views showing another way of assembling of an inner slidable block and an external plate of a central movable unit respectively of the present invention.

FIGS. 45 (I) and (II) are two perspective views showing another way of assembling an inner slidable block 51 and an external plate 52 of a central movable unit respectively of the present invention. As shown in these views, the lower guiding and limiting portion 511 on the bottom of the inner slidable block 51 is excavated to be hollow, the fixing portion 513 of the upper guiding and limiting portion 512 is excavated to form a round hole 516, and a fixing rod 526 is extended down from the bottom of the external plate 52 and is opposite to the round hole 516, the fixing rod 526 being engaged in the round hole 516 during assembly and snugly fitted or adhered. In this way, assembling of the inner slidable block 51 and the external plate 52 is completed.

The embodiments stated above are only examples for illustrating the present invention. It will be apparent to those skilled in this art that various modifications or changes can be made to the members of the present invention without departing from the spirit, scope and characteristic of this invention. Accordingly, all such modifications and changes also fall within the scope of the appended claims and are intended to form part of this invention.

I claim:

1. A four-layer intellectual cube having six sides, each of which is divided vertically and horizontally into smaller movable surfaces, wherein by rotation of the smaller movable surfaces, said six sides can provide a variety of combinations of colors or patterns, said cube comprising:

a central axle block having six sides and located at a center of said four-layer intellectual cube, said six sides of said central axle block being each provided with a pin hole, said axle block comprising a seat block one corner of which is located at the center of said four-layer intellectual cube;

six rotatable blocks having first and second ends, each in the shape of a "T", a pivot joint on the first end of each of the blocks being pivotally connected to each of said pin holes of said central axle block, said rotatable blocks each further comprising a square limiting plate on the second end thereof, a bottom of said square limiting plate being arciform;

twenty-four first slidable blocks providing at four sides of each of said rotatable blocks, a top of each of said first slidable blocks being an abutting portion arranged to abut against one lateral side of one of said square limiting plates on one of said rotatable blocks, a lower portion of each said first slidable block being a limiting portion protruding toward one of said pivot joints of said rotatable block, wherein a front end of said abutting portion is provided with a flange having an arciform bottom, a width of a top of said limiting portion also being arciform and arranged to abut against an arciform bottom of said limiting plate, so that said first slidable blocks are retained in said four-layer intellectual cube by the arciform bottoms of said sides and said lateral limiting plates, a width of said limiting portion being smaller than that of said abutting portion, so that both ends of said abutting portion protrude laterally, the bottoms of said ends of said abutting portion being also arciform;

twelve second slidable blocks, each positioned between two of said first slidable blocks and having a triangular shape, a top of each of said second slidable blocks being equal to a width of said abutting portion of said first slidable blocks and forming therewith a connecting portion both ends of which are arciform and arranged to abut against two corresponding arciform bottom surfaces of said flange, so that said second slidable blocks are retained in said four-layer intellectual cube by said bottom surfaces of said first slidable blocks, a bottom of each said second slidable block being provided with a guiding and limiting portion having a smaller width than said connecting portion, so that both ends of second connecting portion protruding laterally, bottoms of said ends of said connecting portion being also arciform and arranged to abut and conform in shape to the ends of said abutting portion, a width of said guiding and limiting portion being equal to a width of said limiting portion and abutted thereagainst;

twenty-four central movable units, each including an inner slide block and an outer slide plate, wherein said inner slide blocks are each positioned at four corners of said rotatable blocks, and are each displaceable together with a left or right neighboring one of said first slidable blocks, a lower portion of each of said inner slide blocks being a lower guiding and limiting portion which is placed under said abutting portion of a respective said first slidable block, an upper portion of each said inner slide block being an upper guiding and limiting portion the top of which extends slightly out of the top of said abutting portion of said first slidable block; said outer slide plate being in the shape of a thin sheet, a top surface thereof being square, and a set of four of said outer slide plates forming a central movable unit, four of said central movable units being located on each side of said four-layer intellectual square cube;

twenty-four edge movable units, each provided on edges of every side of said four-layer intellectual square cube, a pair on each edge, each of said edge movable units including an inner and an outer portion, said outer portion being square and said inner portion being triangular and extended inwardly to lateral sides of adjacent ones of said first slidable blocks and second slidable blocks, said inner portion having formed therein a lateral arciform slide groove conforming in shape with said abutting portions and said connecting portions provided on the tops of said first slidable blocks and second slidable blocks respectively, so that a bottom of said inner portion is retained in said four-layer intellectual cube by said abutting portions of said first slidable blocks and said connecting portions of said second slidable blocks and yet is slidable along said arciform bottoms of said abutting portions and connecting portions; and eight corner movable units, each including an outer square portion and an inner triangular portion mutually connected by a connecting portion provided therebetween, said eight outer square portions forming eight corners of said four-layer intellectual square cube, said inner triangular portion being engaged in a gap formed by three of said edge movable units adjacent said inner triangular portion to retain said eight corner movable units in said four-layer intellectual cube, a top of said inner triangular portion being arciform, whereby each said corner movable unit is movable together with any of said three edge movable units;

whereby by providing said central axle block, said six rotatable blocks, twenty-four first slidable blocks, twelve second slidable blocks, twenty-four central movable units, twenty-four edge movable units, and eight corner movable units, assembly of said four-layer intellectual square cube is completed.

* * * * *